US008721060B2

(12) United States Patent
Yokoyama et al.

(10) Patent No.: US 8,721,060 B2
(45) Date of Patent: May 13, 2014

(54) LIQUID CIRCULATION SYSTEM

(75) Inventors: Seiichi Yokoyama, Nagano (JP); Tomomi Igawa, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 14 days.

(21) Appl. No.: 13/511,371

(22) PCT Filed: Nov. 26, 2010

(86) PCT No.: PCT/JP2010/071184
§ 371 (c)(1),
(2), (4) Date: Jul. 25, 2012

(87) PCT Pub. No.: WO2011/065511
PCT Pub. Date: Jun. 3, 2011

(65) Prior Publication Data

US 2013/0010037 A1 Jan. 10, 2013

(30) Foreign Application Priority Data

Nov. 27, 2009 (JP) ..... 2009-270313

(51) Int. Cl.
*B41J 2/18* (2006.01)

(52) U.S. Cl.
USPC ..... 347/89

(58) Field of Classification Search
CPC ..... B41J 2/175
USPC ..... 347/84–89, 92, 93
See application file for complete search history.

(56) References Cited

U.S. PATENT DOCUMENTS

| | | | | |
|---|---|---|---|---|
| 5,975,689 | A * | 11/1999 | Pawlowski et al. | 347/86 |
| 6,431,694 | B1 * | 8/2002 | Ross | 347/85 |
| 6,561,637 | B2 * | 5/2003 | Hino | 347/92 |
| 6,783,215 | B2 * | 8/2004 | Yoshida et al. | 347/85 |
| 6,840,605 | B2 * | 1/2005 | Hauck | 347/86 |
| 6,948,803 | B2 * | 9/2005 | Yoshida et al. | 347/85 |
| 7,387,377 | B2 * | 6/2008 | Yoshino et al. | 347/85 |
| 7,556,362 | B2 * | 7/2009 | Akahane | 347/86 |
| 7,566,121 | B2 * | 7/2009 | Ohishi | 347/89 |
| 7,594,717 | B2 * | 9/2009 | Sheinman | 347/89 |
| 7,600,472 | B2 * | 10/2009 | Igarashi et al. | 101/366 |
| 7,841,706 | B2 * | 11/2010 | Ishinaga et al. | 347/84 |
| 8,038,267 | B2 * | 10/2011 | Kinase et al. | 347/85 |
| 8,132,902 | B2 * | 3/2012 | Shibata et al. | 347/89 |

(Continued)

FOREIGN PATENT DOCUMENTS

JP 2006-088564 4/2006

*Primary Examiner* — Matthew Luu
*Assistant Examiner* — Lily Kemathe
(74) *Attorney, Agent, or Firm* — Jianq Chyun IP Office

(57) ABSTRACT

A liquid circulation system includes an inkjet head formed with a common ink flow passage, an ink cartridge, a supply flow passage through which ink is supplied from the ink cartridge to an inlet of the common ink flow passage, a return flow passage through which the ink is returned from the outlet of the common ink flow passage to the ink cartridge, a tube pump sending the ink in the supply flow passage, a tube pump sending the ink in the return flow passage, a pressurization bellows unit pressurizing the ink in the supply flow passage, a pressure reduction bellows unit depressurizing the ink in the return flow passage, a pressurization regulator maintaining the inlet being a center value "+α" of a designated head value, and a differential pressure regulator by which a differential pressure of the ink between the inlet and the outlet is maintained to be "2α".

9 Claims, 7 Drawing Sheets

(56) References Cited

U.S. PATENT DOCUMENTS

| | | | | |
|---|---|---|---|---|
| 8,152,268 | B2 * | 4/2012 | Watanabe | 347/30 |
| 8,342,666 | B2 * | 1/2013 | Lee et al. | 347/89 |
| 8,360,566 | B2 * | 1/2013 | Uptergrove | 347/89 |
| 8,371,686 | B2 * | 2/2013 | Yokouchi | 347/93 |
| 2003/0011668 | A1 * | 1/2003 | Yoshida | 347/86 |
| 2006/0176346 | A1 * | 8/2006 | Momose | 347/85 |
| 2008/0239027 | A1 * | 10/2008 | Kinase et al. | 347/85 |
| 2008/0259117 | A1 * | 10/2008 | Takada | 347/36 |
| 2008/0273046 | A1 * | 11/2008 | Ishinaga et al. | 347/6 |
| 2008/0297577 | A1 * | 12/2008 | Wouters et al. | 347/89 |
| 2009/0109267 | A1 * | 4/2009 | Lee et al. | 347/89 |
| 2010/0079562 | A1 * | 4/2010 | Katada et al. | 347/85 |
| 2010/0110155 | A1 * | 5/2010 | Delueg | 347/93 |
| 2010/0157002 | A1 * | 6/2010 | Takada et al. | 347/85 |
| 2010/0214377 | A1 * | 8/2010 | Yokozawa et al. | 347/85 |
| 2010/0277555 | A1 * | 11/2010 | Katoh et al. | 347/86 |
| 2010/0295908 | A1 * | 11/2010 | Katoh et al. | 347/86 |
| 2011/0096129 | A1 * | 4/2011 | Nishimori | 347/86 |
| 2011/0221835 | A1 * | 9/2011 | Maruyama | 347/85 |

* cited by examiner

LIQUID CIRCULATION SYSTEM

CROSS-REFERENCE TO RELATED APPLICATION

This application is a 371 of international application of PCT application serial no. PCT/JP2010/071184, filed on Nov. 26, 2010, which claims the priority benefit of Japan application no. 2009-270313, filed on Nov. 27, 2009. The entirety of each of the above-mentioned patent applications is hereby incorporated by reference herein and made a part of this specification.

TECHNICAL FIELD

The present invention relates to a liquid circulation system which is mounted on a droplet ejection device.

BACKGROUND ART

Commonly, in a large-scale inkjet printer, ink is supplied to an inkjet head from an ink cartridge which is detachably mounted. Some of the inks such as metallic ink, pearl ink, white ink and the like contain fine particles (pigment or the like) whose specific gravity is different from liquid component. The specific gravity of the fine particle which is contained in the ink is large in comparison with that of the liquid component and the fine particle is, for example, made of metal or ore.

When the ink is left to stand for a long time under an environment that ink flow is stopped, fine particles whose specific gravity is large are precipitated down in the liquid and, as a result, clogging of piping and failure of ejection may be occurred.

Further, a cross-sectional area and a volume of piping are changed due to installation of a joint or a sub tank based on arranging layout of piping and functions of an inkjet printer. Stagnation of ink may occur in the portion when a used amount of the ink is small and, as a result, the fine particles are precipitated to cause a malfunction of the printer and thus a desired printed object is not obtained.

Further, in the inkjet printer, at the time of introducing ink or the like, bubbles stagnated in the middle of piping or in a common ink flow passage of the head are carried to a nozzle together with the ink, which may cause a failure of ejection.

A method for circulating ink may be used in order to solve the problem. For precipitation, ink is always moved through circulation of the ink and thereby the precipitation is prevented by agitating action through the flow. Further, for the bubble, the stagnated bubbles are flowed to a bubble trap or an ink reservoir tank to eliminate the bubbles.

The circulation provides the above-mentioned merits but attention should be given to a pressure control. A pressure at a nozzle portion in an inkjet head gives a large effect to the ejection and thus an ink pressure at the nozzle portion is controlled at a fixed negative pressure and thereby a meniscus having a predetermined shape is formed in the nozzle.

Therefore, conventionally, ink is circulated while adjusting the pressure so as not to affect the meniscus formed in each nozzle (see, for example, Patent Literature 1).

CITATION LIST

Patent Literature

[PTL 1] Japanese Patent Laid-Open No. 2006-088564

SUMMARY OF INVENTION

Technical Problem

As described in the background art, in an inkjet printer, in order to optimize a shape and a flight trajectory of an ink droplet ejected from each nozzle of the inkjet head, a water head value (pressure) of ink in the inkjet head is adjusted or the like and the ink supplied to each nozzle is formed in a meniscus having a predetermined shape.

However, in the conventional liquid circulation system, a pressure sensor for measuring a pressure in an ink flow passage or a complicated pressure adjustment device is used and thus the system is expensive.

In view of the problem described above, an objective of the present invention is to provide a liquid circulation system in which liquid is appropriately circulated at a low cost without using an expensive pressure sensor while the number of part items is reduced and which is capable of preventing precipitation of fine particles in the liquid and removing bubbles in the liquid flow passage.

Solution to Problem

The present invention provides a liquid circulation system which is mounted on a droplet ejection device including a droplet ejection head which is formed with a common flow passage communicated with a plurality of nozzles from which the droplets are ejected, a liquid filling container which is filled with liquid that is supplied to the droplet ejection head, a first flow passage through which the liquid is supplied from the liquid filling container to one end part of the common flow passage, a second flow passage through which the liquid is returned from the other end part of the common flow passage to the liquid filling container, a differential pressure generating means structured to pressurize the liquid on the one end part side in the common flow passage and depressurize the liquid on the other end part side in the common flow passage, a pressurization regulator which is disposed between the differential pressure generating means and the one end part of the common flow passage and is structured to maintain the liquid at the one end part in the common flow passage to be a first pressure, and a differential pressure regulator which is disposed between the differential pressure generating means and the other end part of the common flow passage and is structured to maintain a differential pressure between both end parts in the common flow passage to be a second pressure. In this case, the second pressure which is the differential pressure between both end parts in the common ink flow passage is a value which is obtained by subtracting a pressure of the other end part from a pressure (first pressure) of the one end part in the common ink flow passage.

According to the liquid circulation system in accordance with the present invention, liquid is supplied from a liquid filling container to one end part of the common flow passage of the droplet ejection head through a first flow passage and the liquid is returned from the other end part of the common flow passage to the liquid filling container through the second flow passage. Therefore, the liquid which is filled in the liquid filling container can be circulated through the liquid flow passage passing through the liquid filling container, the first flow passage, the common flow passage and the second flow passage. Further, the differential pressure generating part pressurizes the liquid on the one end part side in the common flow passage and depressurizes the liquid on the other end part side in the common flow passage and thereby a differential pressure is generated between both end parts of the common flow passage. Therefore, the liquid can be circulated through the liquid flow passage passing through the liquid filling container, the first flow passage, the common flow passage and the second flow passage and thus composition such as fine particles contained in the liquid can be agitated and sedimentation and precipitation of the composition such as the fine particles are restrained and bubbles are discharged. Further, since the pressurization regulator is provided between the differential pressure generating means and the one end part of the common flow passage, even when a pressure generated by the differential pressure generating means is varied, the liquid at the one end part in the common flow passage can be maintained to be a predetermined first pressure. Further, since the differential pressure regulator is provided between the differential pressure generating means and the other end part of the common flow passage, even when a liquid pressure of the other end part side in the common flow passage which is depressurized by the differential pressure generating means is varied, the differential pressure of the both end parts in the common flow passage can be maintained to be the predetermined second pressure. As described above, since the pressurization regulator and the differential pressure regulator are used, even when a differential pressure generating means which is unable to adjust a pressure with a high degree of accuracy is adopted, variation of the pressure applied to the both end parts of the common ink flow passage is restrained and thus the liquid can be circulated while the meniscus in the nozzle is maintained appropriately. In addition, the differential pressure generating means is not required to use an expensive member such as a pressure sensor and a complicated control and the pressurization regulator and the differential pressure regulator are used in a simple and easy structure and thus the cost of the liquid circulation system can be reduced.

In this case, it is preferable that the differential pressure regulator shuts off flow of the liquid when a pressure obtained by subtracting a pressure of the liquid of the other end part of the common flow passage from a pressure of the liquid of the one end part of the common flow passage becomes higher than the second pressure, and the differential pressure regulator flows the liquid when the pressure obtained by subtracting the pressure of the liquid of the other end part of the common flow passage from the pressure of the liquid of the one end part of the common flow passage becomes lower than the second pressure. According to this structure, the flow of the liquid is shut off when a pressure obtained by subtracting a pressure of the liquid of the other end part of the common flow passage from a pressure of the liquid of the one end part of the common flow passage becomes higher than the second pressure. Therefore, even when a pressure generated by the differential pressure generating means is varied, the liquid pressure of the other end part can be maintained to be a predetermined differential pressure with respect to the liquid pressure of the one end part in the common flow passage.

Further, it is preferable that the pressurization regulator shuts off the flow of the liquid when a liquid pressure at the one end part in the common flow passage becomes higher than the first pressure and makes the liquid flow when the liquid pressure at the one end part in the common flow passage becomes lower than the first pressure. According to this structure, since the flow of the liquid is shut off when a liquid pressure at the one end part in the common flow passage becomes higher than the first pressure, even when a pressure generated by the differential pressure generating means is varied, a pressure of the liquid at the one end part in the common flow passage is prevented from becoming lower than the first pressure and the liquid at the one end part in the common flow passage is maintained to be the first pressure.

Further, it is preferable that the differential pressure regulator is provided with a first pressure chamber into which the liquid returned from the other end part of the common flow passage is flowed, a second pressure chamber which is formed with a through hole communicated with the first pressure chamber and from which the liquid is discharged to a flow passage communicated with a negative pressure side of the differential pressure generating part, a third pressure chamber into which the liquid supplied to the one end part of the common flow passage is flowed, a diaphragm which separates the first pressure chamber from the third pressure chamber, a valve element which is connected with the diaphragm for opening and closing the through hole, and a pressure control spring which urges the valve element in a direction for opening the through hole. According to this structure, when a force which is applied to the diaphragm in a direction for closing the valve element by a differential pressure which is obtained by subtracting a liquid pressure flowed into the first pressure chamber from a liquid pressure flowed into the third pressure chamber becomes larger than a force of the pressure control spring which presses the valve element in an open direction, the valve element closes the through hole and supply of the liquid is stopped. Further, when the force which is applied to the diaphragm in the direction for closing the valve element by the differential pressure which is obtained by subtracting the liquid pressure flowed into the first pressure chamber from the liquid pressure flowed into the third pressure chamber becomes smaller than the force of the pressure control spring which presses the valve element in the open direction, the valve element opens the through hole and supply of the liquid is started again. In this manner, passing and stop of the liquid can be mechanically performed without a complicated control and thus the differential pressure between both end parts in the common flow passage can be maintained to be the second pressure.

Further, it is preferable that the pressurization regulator is provided with a first pressure chamber into which the liquid is flowed from the liquid filling container through a pressurization side of a differential pressure generating part, a second pressure chamber which is formed with a through hole communicated with the first pressure chamber and from which the liquid is sent to the one end part of the common flow passage, a diaphragm which separates the second pressure chamber from ambient atmosphere, a valve element which is connected with the diaphragm for opening and closing the through hole, and a pressure control spring which urges the valve element in a direction for closing the through hole. According to this structure, a pressure of the second pressure chamber communicated with the one end part of the common flow passage is normally a negative pressure and thus the diaphragm is drawn to the second pressure chamber side by the outside under an atmospheric pressure and a force in a direction for opening the valve element is generated. In this case, when a force which is applied to the diaphragm by the liquid pressure of the second pressure chamber which presses the valve element in an open direction becomes smaller than a force of the pressure control spring which presses the valve element in a close direction, the valve element closes the through hole and supply of the liquid is stopped. Further, when the force which is applied to the diaphragm by the liquid pressure of the second pressure chamber which presses the valve element in the open direction becomes larger than the force of the pressure control spring which presses the valve element in the close direction, the valve element opens the through hole and the supply of the liquid is started again. In this manner, passing and stop of the liquid can be mechanically performed without a complicated control and thus the liquid pressure at the one end part of the common flow passage can be maintained to be the set pressure.

Further, it may be structured that air which is adjusted at a predetermined pressure is introduced into the pressurization regulator and the pressurization regulator opens and closes the liquid flow passage based on comparison of a pressure of the air with a liquid pressure which is discharged to the one end part of the common flow passage. In this case, supply and stop of the liquid is switched based on a pressure difference between the liquid which is discharged to the one end part of the common flow passage and the air having a predetermined set pressure. Therefore, the liquid pressure at the one end part of the common flow passage can be easily changed by changing the set pressure of the air and thus the degree of freedom of the set pressure is remarkably improved and, even when a plurality of the pressurization regulators is used, the set pressure can be changed simultaneously.

In this case, it may be structured that the pressurization regulator is provided with a first pressure chamber into which the liquid is flowed from the liquid filling container, a second pressure chamber which is formed with a through hole communicated with the first pressure chamber and from which the liquid is discharged to the one end part of the common flow passage, a third pressure chamber into which air at a predetermined pressure is flowed, a diaphragm which separates the second pressure chamber from the third pressure chamber, and a valve element which is connected with the diaphragm for opening and closing the through hole. According to this structure, when a liquid pressure discharged from the second pressure chamber becomes higher than the pressure of the air which is flowed into the third pressure chamber, the valve element closes the through hole and the supply of the liquid is stopped and, when the liquid pressure discharged from the second pressure chamber becomes lower than the pressure of the air which is flowed into the third pressure chamber, the valve element opens the through hole and the supply of the liquid is started again. Therefore, passing and stop of the liquid can be mechanically performed by setting the pressure of the air which is flowed into the third pressure chamber without performing complicated control and thus the liquid pressure at the one end part of the common flow passage can be further surely maintained to be the set pressure.

Further, it is preferable that the first pressure and the second pressure are set to be within a range of a designated water head of the droplet ejection head, and the first pressure is a pressure higher by a predetermined pressure than a center value of the designated head value of the droplet ejection head, and the second pressure is a pressure of two times of the predetermined pressure. When a pressure generated by the pressurization regulator at the one end part of the common flow passage and a pressure generated by the differential pressure regulator at the other end part of the common flow passage are set to be values interposing the center value of the designated head value as described above, an average pressure of the common flow passage can be brought close to the center value of the designated head value and thus the meniscus of the liquid formed in each nozzle of the droplet ejection head can be prevented from being broken.

Further, it may be structured that the differential pressure generating means pressurizes the liquid on the one end part side in the common flow passage by a pressurization bellows for pressurizing the liquid and a first tube pump for sending the liquid to the liquid droplet ejection head side, and the differential pressure generating means depressurizes the liquid on the other end part side in the common flow passage by a pressure reduction bellows for depressurizing the liquid and a second tube pump for sending the liquid to the liquid filling container side. According to this structure, the one end part side in the common flow passage can be pressurized by providing the pressurization bellows and the first tube pump in the first flow passage and the liquid on the other end part side in the common flow passage can be depressurized by providing the pressure reduction bellows and the second tube pump in the second flow passage. Therefore, a predetermined differential pressure is generated between both end parts of the common flow passage with a simple structure, i.e., the bellows and the tube pump and thus the cost can be further reduced.

Further, it may be structured that the differential pressure generating means pressurizes the liquid on the one end part side in the common flow passage by a pressurization bellows for pressurizing the liquid and a first tube pump for sending the liquid to the droplet ejection head side, and a height difference is provided between the droplet ejection head and the liquid filling container so that liquid pressure at the other end part in the common flow passage is lower than liquid pressure at the one end part in the common flow passage. A differential pressure may be also generated between both end parts of the common flow passage by providing the pressurization bellows, the first tube pump and the pressurization regulator in the first flow passage and by providing a height difference between the droplet ejection head and the liquid filling container as described above.

Further, the differential pressure generating means may include a differential pressure generating pump which is provided in the first flow passage or the second flow passage for generating a differential pressure. A predetermined differential pressure may be also generated between both end parts of the common flow passage by providing a differential pressure generating pump in the first flow passage or the second flow passage as described above.

Advantageous Effects of Invention

According to the present invention, liquid is appropriately circulated at a low cost without using an expensive pressure sensor while the number of part items is reduced and thus precipitation of fine particles in the liquid can be prevented and bubbles in the liquid flow passage can be removed.

BRIEF DESCRIPTION OF DRAWINGS

FIG. 3A shows a state that a valve is closed and FIG. 3B shows a state that the valve is opened.

FIG. 4A shows a state that a valve is closed and FIG. 4B shows a state that the valve is opened.

FIG. 8A shows a state that a valve is closed and FIG. 8B shows a state that the valve is opened.

DESCRIPTION OF EMBODIMENTS

Preferred embodiments of a liquid circulation system in accordance with the present invention will be described in detail below with reference to the accompanying drawings. In these embodiments, a liquid circulation system in accordance with the present invention is applied to an ink circulation system mounted on the inkjet printer which is a droplet ejection device. An ink circulation system in accordance with the embodiments is a system in which ink is circulated through an ink flow passage of an inkjet printer. Further, ink which is circulated in the ink circulation system is, for example, metallic ink, pearl ink or white ink, in which fine particles whose specific gravity is different from liquid component such as pigment are contained. In the following description, the same reference sign is used in the same or corresponding portions.

First Embodiment

Figure 1:
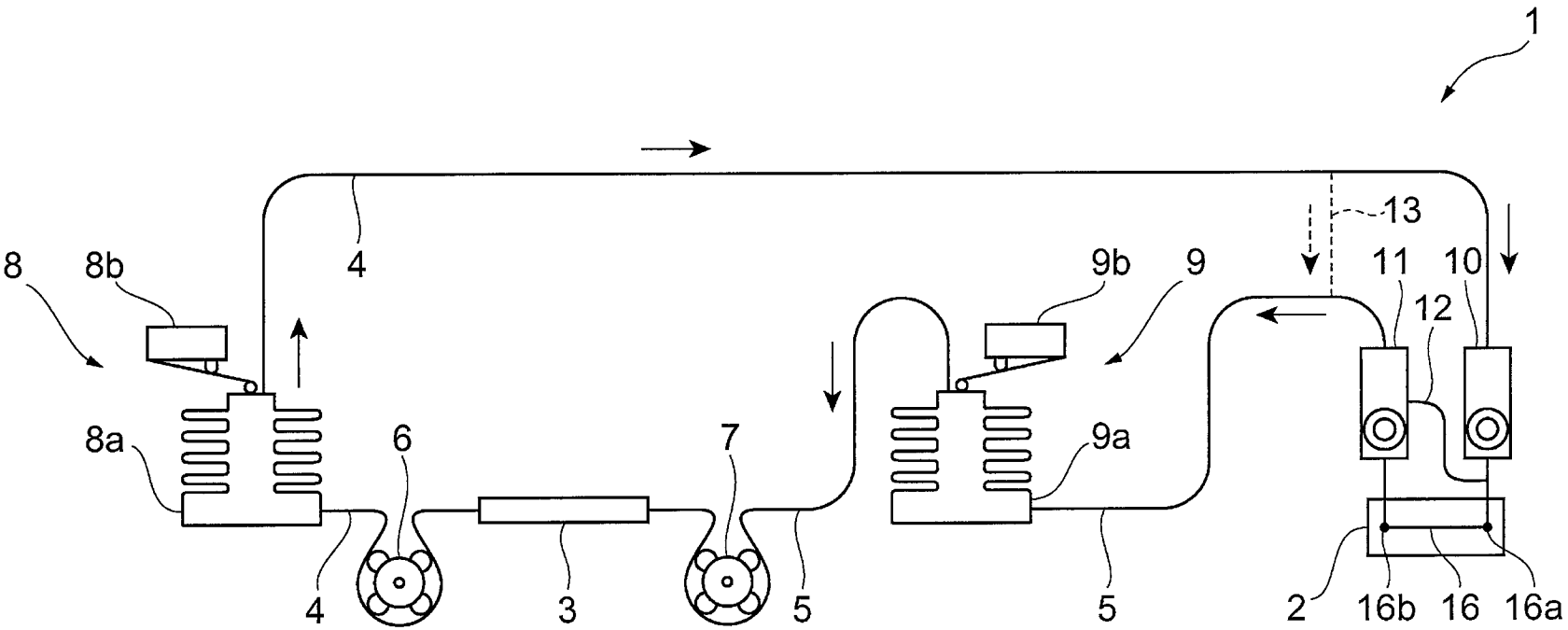
FIG. 1 is a schematic structure view showing an ink circulation system in accordance with a first embodiment of the present invention.
Figure 2:
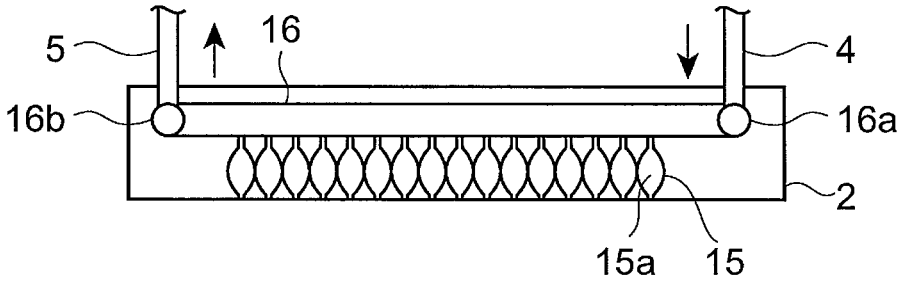
FIG. 2 is a schematic cross-sectional view showing an inkjet head.

FIG. 1 is a schematic structure view showing an ink circulation system in accordance with a first embodiment of the present invention, and FIG. 2 is a schematic cross-sectional view showing an inkjet head. As shown in FIG. 1, an ink circulation system 1 in accordance with the first embodiment of the present invention includes an inkjet head 2, an ink cartridge 3, a supply flow passage 4, a return flow passage 5, a tube pump 6, a tube pump 7, a pressurization bellows unit 8, a pressure reduction bellows unit 9, a pressurization regulator 10, a differential pressure regulator 11, a branched flow passage 12 and a high speed circulating flow passage 13.

The inkjet head 2 is a head for ejecting ink droplets. Therefore, as shown in FIG. 2, the inkjet head 2 is formed with a number of nozzles 15 and a common ink flow passage 16 which is communicated with all the nozzles 15.

The common ink flow passage 16 is a flow passage through which ink supplied from the ink cartridge 3 to the inkjet head 2 is flowed. The common ink flow passage 16 is communicated with all the nozzles 15 which are formed in the inkjet head 2 and the ink supplied from the ink cartridge 3 to the inkjet head 2 is distributed and supplied to the respective nozzles 15. One end of the common ink flow passage 16 is formed with an inlet 16*a* which introduces the ink supplied from the supply flow passage 4 into the common ink flow passage 16 and the other end of the common ink flow passage 16 is formed with an outlet 16*b* through which the ink supplied to the common ink flow passage 16 is discharged to the return flow passage 5. The inlet 16*a* and the outlet 16*b* are formed at both ends of the common ink flow passage 16. Therefore, the ink introduced from the inlet 16*a* is flowed from the one end of the common ink flow passage 16 to the other end and is discharged from the outlet 16*b*.

Each nozzle 15 ejects the ink supplied from the common ink flow passage 16 as an ink droplet having a predetermined quantity. Each nozzle 15 is formed in a minute tube-like shape. Each nozzle 15 is formed with a chamber 15*a* whose diameter becomes partially large so as to be bulged. A piezoelectric element not shown for pressurizing the inside of the chamber 15*a* is attached to the chamber 15*a*. When the piezoelectric element is driven to pressurize the inside of the chamber 15*a*, a predetermined quantity of ink is pushed out from the chamber 15*a* and an ink droplet having a predetermined size is ejected from a tip end of each nozzle 15. Further, in order to prevent leakage of the ink from each nozzle 15, a head value of the ink and the like are adjusted and the ink supplied to the nozzle 15 is held in a negative pressure state. In addition, in order to optimize a shape and a flight trajectory of an ink droplet ejected from each nozzle 15, the head value of the ink and the like are adjusted to form the ink supplied to each nozzle 15 in a meniscus having a predetermined shape.

The inkjet head 2 structured as described above is mounted on a carriage not shown which is attached so as to be movable in a scan direction. Further, the inkjet head 2 ejects ink droplets when the carriage is moved in the scan direction and thereby an image or the like is printed on a recording medium which is placed on a platen not shown.

The ink cartridge 3 is an ink container which is filled with ink for being supplied to the inkjet head 2. The ink cartridge 3 is disposed at an arbitrary height irrespective of the designated head value.

The supply flow passage 4 is structured of a long and thin tube-like member (tube), which communicates the ink cartridge 3 with the inkjet head 2 and the ink filled in the ink cartridge 3 is supplied to the inkjet head 2 through the supply flow passage 4. The tube pump 6, the pressurization bellows unit 8 and the pressurization regulator 10 are attached in the supply flow passage 4 between the ink cartridge 3 and the inkjet head 2. Therefore, the supply flow passage 4 is structured of a flow passage which communicates the ink cartridge 3 with the tube pump 6, a flow passage which communicates the tube pump 6 with the pressurization bellows unit 8, a flow passage which communicates the pressurization bellows unit 8 with the pressurization regulator 10, and a flow passage which communicates the pressurization regulator 10 with the inkjet head 2.

The return flow passage 5 is structured of a long and thin tube-like member (tube), which communicates the inkjet head 2 with the ink cartridge 3 and the ink filled in the inkjet head 2 is returned to the ink cartridge 3 through the return flow passage 5. The differential pressure regulator 11, the pressure reduction bellows unit 9 and the tube pump 7 are attached in the return flow passage 5 between the inkjet head 2 and the ink cartridge 3. Therefore, the return flow passage 5 is structured of a flow passage which communicates the inkjet head 2 with the differential pressure regulator 11, a flow passage which communicates the differential pressure regulator 11 with the pressure reduction bellows unit 9, a flow passage which communicates the pressure reduction bellows unit 9 with the tube pump 7, and a flow passage which communicates the tube pump 7 with the ink cartridge 3.

The branched flow passage 12 is a flow passage which communicates the supply flow passage 4 disposed between the pressurization regulator 10 and the inlet 16*a* of the common ink flow passage 16 with the differential pressure regulator 11 for branching the ink outputted from the pressurization regulator 10 to the differential pressure regulator 11. The branched flow passage 12 is, similarly to the supply flow passage 4 and the return flow passage 5, structured of a long and thin tube-like member (tube).

The tube pump 6 is a liquid feeding device which sends the ink in the supply flow passage 4 toward the inkjet head 2. The tube pump 6 is structured of a built-in tube not shown and a built-in roller which is rotated while crushing the tube. The supply flow passage 4 is connected to both ends of the built-in tube. Therefore, the built-in roller is rotated while crushing the built-in tube of the tube pump 6 and thereby the ink supplied to the supply flow passage 4 from the ink cartridge 3 is forcibly sent to the inkjet head 2 side. Further, the tube pump 6 is capable of adjusting a flow rate of the ink flowing through the supply flow passage 4 by adjusting the rotation number of the built-in roller.

The tube pump 7 is a liquid feeding device which sends the ink in the return flow passage 5 toward the ink cartridge 3. The tube pump 7 is structured of a built-in tube not shown and a built-in roller which is rotated while crushing the tube. The return flow passage 5 is connected to both ends of the built-in tube. Therefore, the built-in roller is rotated while crushing the built-in tube of the tube pump 7 and thereby the ink discharged from the common ink flow passage 16 to the return flow passage 5 is forcibly sent to the ink cartridge 3 side. Further, the tube pump 7 is capable of adjusting a flow rate of the ink flowing through the return flow passage 5 by adjusting the rotation number of the built-in roller.

The pressurization bellows unit 8 is structured of a metal bellows 8*a* structured of a bellows-like expansion and contraction pipe and a micro switch 8*b* which is provided on an upper side of the metal bellows 8*a* and whose "ON/OFF" is switched by expansion and contraction of the metal bellows 8*a*. The pressurization bellows unit 8 is disposed between the tube pump 6 and the pressurization regulator 10. The micro switch 8*b* is interlocked with the tube pump and, when the metal bellows 8*a* is expanded, the micro switch 8*b* becomes an "OFF" position and, when the metal bellows 8*a* is contracted, the micro switch 8*b* becomes an "ON" position. The metal bellows 8*a* is, for example, structured of stainless steel.

In the pressurization bellows unit 8, the metal bellows 8*a* is expanded by forcibly sending ink into its inside from the tube pump 6. When the metal bellows 8*a* is expanded to a predetermined length, the micro switch 8*b* is turned "OFF" and the drive of the tube pump 6 is stopped. As a result, the expanded metal bellows 8*a* is contracted by its restoring force and thus the ink flowing through the supply flow passage 4 is pressurized. When the metal bellows 8*a* is contracted to a predetermined length, the micro switch 8*b* is turned "ON" and the drive of the tube pump 6 is started again. In this manner, the ink flowing through the supply flow passage 4 is pressurized by expansion and contraction of the metal bellows 8*a*. Therefore, the pressurization bellows unit 8 is capable of adjusting a pressure value for pressurizing the ink flowing through the supply flow passage 4 by adjusting a spring constant of the metal bellows 8*a*. In this embodiment, the pressurization bellows unit 8 pressurizes the ink flowing through the supply flow passage 4, for example, in a range from 5000 to 20000 Pa (≈500-2000 mm $H_2O$) by setting the spring constant of the metal bellows 8*a*.

The pressure reduction bellows unit 9 is structured of a metal bellows 9*a* structured of a bellows-like expansion and contraction pipe and a micro switch 9*b* which is provided on an upper side of the metal bellows 9*a* and whose "ON/OFF" is switched by expansion and contraction of the metal bellows 9*a*. The pressure reduction bellows unit 9 is disposed between the differential pressure regulator 11 and the tube pump 7. The micro switch 9*b* is interlocked with the tube pump and, when the metal bellows 9*a* is expanded, the micro switch 9*b* becomes an "ON" position and, when the metal bellows 9*a* is contracted, the micro switch 9*b* becomes an "OFF" position. The metal bellows 8*a* is, for example, structured of stainless steel.

In the pressure reduction bellows unit 9, the metal bellows 9*a* is contracted by forcibly sucking the ink by the tube pump 7. When the metal bellows 9*a* is contracted to a predetermined length, the micro switch 9*b* is turned "OFF" and the drive of the tube pump 7 is stopped. As a result, the contracted metal bellows 9*a* is expanded by its restoring force and the ink flowing through the return flow passage 5 is depressurized. When the metal bellows 9*a* is expanded to a predetermined length, the micro switch 9*b* is turned "ON" and the drive of the tube pump 7 is started again. In this manner, the ink flowing through the return flow passage 5 is depressurized by expansion and contraction of the metal bellows 9*a*. Therefore, the pressure reduction bellows unit 9 is capable of adjusting a pressure value for depressurizing the ink flowing through the return flow passage 5 by adjusting a spring constant of the metal bellows 9*a*. In this embodiment, the pressure reduction bellows unit 9 depressurizes the ink flowing through the return flow passage 5, for example, in a range from −5000 to −20000 Pa by setting the spring constant of the metal bellows 9*a*.

The pressurization regulator 10 is disposed between the pressurization bellows unit 8 and the inkjet head 2 and the pressurization regulator 10 is a regulator so that an inlet 16*a* of the common ink flow passage 16 is maintained to be not more than a predetermined set pressure. The pressurization regulator 10 is also referred to as a pressurization damper.

Figure 3A:
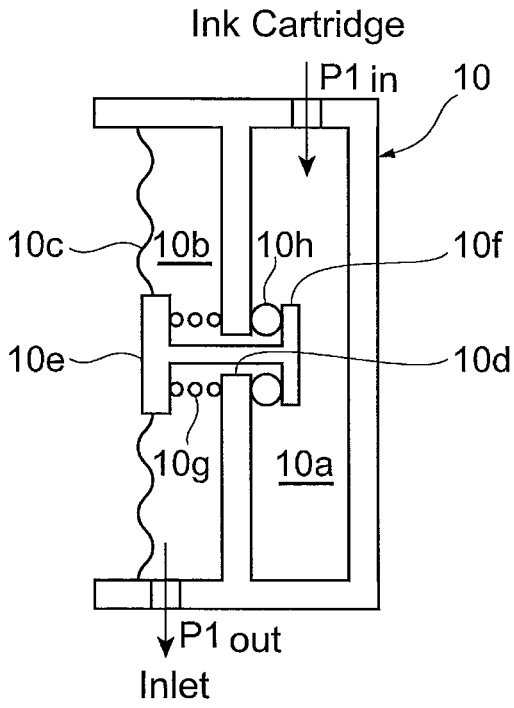
FIG. 3A and FIG. 3B are views showing a model of a pressurization regulator.
Figure 3B:
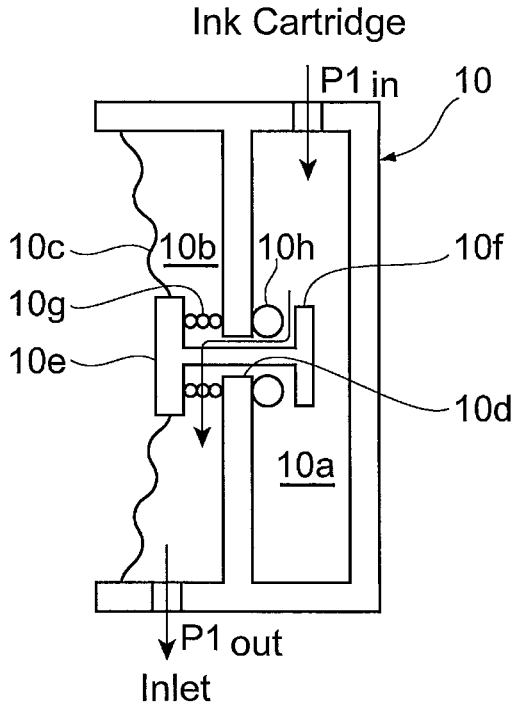

FIG. 3A and FIG. 3B are views showing a model of the pressurization regulator. FIG. 3A shows a state that a valve is closed and FIG. 3B shows a state that the valve is opened. As shown in FIGS. 3A and 3B, the pressurization regulator 10 is formed of a first pressure chamber 10*a* into which the ink supplied from the ink cartridge 3 is flowed, and a second pressure chamber 10*b* which is covered by a diaphragm 10*c* and from which the ink is flowed out to the inlet 16*a* of the common ink flow passage 16. An outside of the diaphragm 10*c* covering the second pressure chamber 10*b* is exposed to the atmospheric pressure. In addition, the pressurization regulator 10 is formed with a through hole 10*d* which communicates the first pressure chamber 10*a* with the second pressure chamber 10*b* to flow the ink from the first pressure chamber 10*a* to the second pressure chamber 10*b*. A valve element 10*e* for opening and closing the through hole 10*d* is inserted into the through hole 10*d*. One end of the valve element 10*e* is connected with the diaphragm 10*c* and is movably held by the diaphragm 10*c* and its other end is formed with a valve 10*f* for closing the through hole 10*d* from the first pressure chamber 10*a* side. In the first pressure chamber 10*a*, an O-ring 10*h* for sealing is attached at a position corresponding to the valve 10*f*. The valve element 10*e* is urged in a direction in which the valve 10*f* closes the through hole 10*d* by a pressure control spring 10*g*. The pressure control spring 10*g* is capable of being expanded and contracted by an adjusting screw not shown.

A pressure of the ink flowing into the first pressure chamber 10*a* is set to be "P1in", a pressure of the ink flowing out from the second pressure chamber 10*b* is set to be "P1out", an area of the diaphragm 10*c* is set to be "A1", and an urging force of the pressure control spring 10*g* is set to be "F1". The pressure "P1out" of the ink flowing out from the second pressure chamber 10*b* is set to be a negative pressure so that a shape of the ink supplied to each nozzle is formed in a predetermined meniscus shape.

Normally, since the pressure "P1out" is a negative pressure, a force obtained by multiplying the "P1out" by the area "A1" is a force acting in a direction for opening the valve element 10*e* (right direction in FIGS. 3A and 3B). In addition, the urging force "F1" of the pressure control spring 10*g* is a force acting in a direction for closing the valve element 10*e* (left direction in FIGS. 3A and 3B).

Therefore, as shown in FIG. 3A, when a force acting to open the valve element 10*e* which is obtained by multiplying the "P1out" by the area "A1" becomes not more than the urging force "F1" acting to close the valve element 10*e;*

(|F1|≥|P1out×A1|), the valve element 10*e* is urged to the left side in FIGS. 3A and 3B by the urging force "F1" of the pressure control spring 10*g* and the through hole 10*d* is closed by the valve 10*f*. In this manner, the flow of the ink from the first pressure chamber 10*a* to the second pressure chamber 10*b* is shut off and the supply of the ink to the inlet 16*a* is stopped. In the above-mentioned expression, "| |" is a symbol representing an absolute value.

On the other hand, as shown in FIG. 3B, when the force acting to open the valve element 10*e* which is obtained by multiplying the "P1out" by the area "A1" becomes larger than the urging force "F1" acting to close the valve element 10*e;*

(|F1|<|P1out×A1|), the diaphragm 10*c* is deformed to the right side in FIGS. 3A and 3B against the urging force "F1" of the pressure control spring 10*g* to open the through hole 10*d*. As a result, the ink is flowed into the second pressure chamber 10*b* from the first pressure chamber 10*a* and supply of the ink to the inlet 16*a* is started again.

In this case, in order to control the pressure "P1in" to be a constant pressure by opening and closing the valve 10*f*, the pressure "P1in" is required to be not less than the pressure "P1out" and it is preferable that the pressure "P1in" is set to be a sufficiently higher value than the pressure "P1out".

Strictly, in the pressurization regulator 10, a pressure obtained by multiplying a force of the pressure "P1in" acting on the valve 10*f* by an area of the valve 10*f* is occurred. However, since the area of the valve 10*f* is normally small, the force may be ignored.

As described above, when an open-and-close operation of the valve 10*f* is repeated in a state that the pressure "P1in" is not less than the pressure "P1out", the pressure "P1out" is maintained to be substantially constant although some variation may be occurred. As a result, the pressure "P1out" which is maintained by the pressurization regulator 10 becomes a set pressure of the pressurization regulator 10. The set pressure of the pressurization regulator 10 is determined based on the urging force "F1" of the pressure control spring 10*g* and the area "A1" of the diaphragm 10*c* and thus the set pressure of the pressurization regulator 10 can be adjusted by adjusting the strength of the pressure control spring 10*g*.

Then, the set pressure of the pressurization regulator 10 is set to be a center value "+α" (first pressure) of the designated head value by adjusting the strength of the pressure control spring 10*g*. As a result, the pressure "P1out" of the ink outputted from the second pressure chamber 10*b* by an open-and-close operation of the valve 10*f* is maintained to be the center value "+α" of the designated head value and thus the ink pressure of the inlet 16*a* communicated with the second pressure chamber 10*b* is also maintained to be the center value "+α" of the designated head value.

The differential pressure regulator 11 is disposed between the pressure reduction bellows unit 9 and the inkjet head 2 and the differential pressure regulator 11 is a regulator which maintains a differential pressure of the ink between the inlet 16*a* and the outlet 16*b* within a predetermined range.

Figure 4A:
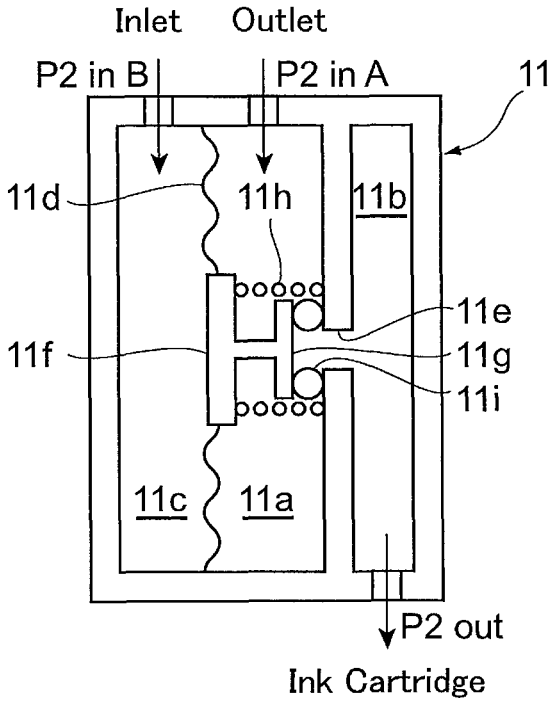
FIG. 4A and FIG. 4B are views showing a model of a differential pressure regulator.
Figure 4B:
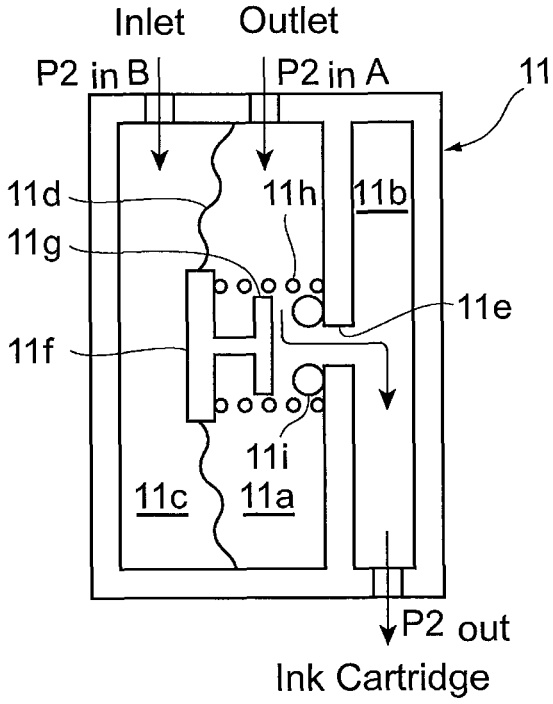

FIG. 4A and FIG. 4B are views showing a model of the differential pressure regulator. FIG. 4A shows a state that a valve is closed and FIG. 4B shows a state that the valve is opened. As shown in FIGS. 4A and 4B, the differential pressure regulator 11 is formed with a first pressure chamber 11*a* into which ink returned from the outlet 16*b* of the inkjet head 2 is flowed, a second pressure chamber 11*b* from which ink is flowed out to the ink cartridge 3, and a third pressure chamber 11*c* which is communicated with the branched flow passage 12 and into which the ink supplied to the inlet 16*a* of the inkjet head 2 is flowed. The first pressure chamber 11*a* and the third pressure chamber 11*c* are partitioned by a diaphragm 11*d*. The ink outputted from the pressurization regulator 10 is flowed into the third pressure chamber 11*c* and thus the pressure of the ink flowed into the third pressure chamber 11*c* is equal to the pressure of the ink at the inlet 16*a* in the common ink flow passage 16. Further, the differential pressure regulator 11 is formed with a through hole 11*e* through which ink is flowed between the first pressure chamber 11*a* and the second pressure chamber 11*b*, and a valve element 11*f* for opening and closing the through hole 11*e* is provided. One end of the valve element 11*f* is connected with the diaphragm 11*d* and is movably held by the diaphragm 11*d* and its other end is formed with a valve 11*g* for closing the through hole 11*e* from the first pressure chamber 11*a* side. In the first pressure chamber 11*a*, an O-ring 11*i* for sealing is attached at a position corresponding to the valve 11*g*. The valve element 11*f* is urged by the pressure control spring 11*h* in a direction so that the valve 11*g* opens the through hole 11*e*. Further, the pressure control spring 11*h* is capable of being expanded and contracted by an adjusting screw not shown.

A pressure of the ink flowing into the first pressure chamber 11*a* is set to be "P2inA", a pressure of the ink flowing into the third pressure chamber 11*c* is set to be "P2inB", a pressure of the ink flowing out from the second pressure chamber 11*b* is set to be "P2out", an area of the diaphragm 11*d* is set to be "A2", and an urging force of the pressure control spring 11*h* is set to be "F2". As described above, the pressure "P2inB" of the ink flowing into the third pressure chamber 11*c* is equal to the pressure of the ink at the inlet 16*a* in the common ink flow passage 16. Further, the pressure "P2inA" of the ink flowing into the first pressure chamber 11*a* is set to be a negative pressure so that a shape of the ink supplied to each nozzle is formed in a predetermined meniscus shape.

Further, when the pressure "P2inA" is higher than the pressure "P2inB", a force which is obtained by multiplying a value subtracting the pressure "P2inA" from the pressure "P2inB" by the area "A2" becomes a force acting in a direction for opening the valve element 11*f* (left direction in FIGS. 4A and 4B). When the pressure "P2inA" is lower than the pressure "P2inB", a force which is obtained by multiplying the value subtracting the pressure "P2inA" from the pressure "P2inB" by the area "A2" becomes a force acting in a direction for closing the valve element 11*f* (right direction in FIGS. 4A and 4B). In addition, the urging force "F2" of the pressure control spring 11*h* is a force acting in a direction for opening the valve element 11*f* (left direction in FIGS. 4A and 4B).

Therefore, as shown in FIG. 4A, when a force which is obtained by multiplying a value subtracting the pressure "P2inA" from the pressure "P2inB" by the area "A2" becomes not less than the urging force "F2" (absolute value) acting to open the valve element 11*f*; (|F2|≤|(P2inB−P2inA)×A2|), the valve element 11*f* is moved to the right side in FIGS. 4A and 4B against the urging force "F2" of the pressure control spring 11*h* and the through hole 11*e* is closed by the valve 11*g*. Accordingly, the flow of the ink from the first pressure chamber 11*a* to the second pressure chamber 11*b* is shut off and the discharge of the ink from the outlet 16*b* is stopped.

On the other hand, as shown in FIG. 4B, when a force obtained by multiplying the value subtracting the pressure "P2inA" from the pressure "P2inB" by the area "A2" becomes smaller than the urging force "F2" (absolute value) acting to open the valve element 11*f*; (|F2|>|(P2inB−P2inA)×A2|), the valve element 11*f* is moved to the left side in FIGS. 4A and 4B by the urging force "F2" of the pressure control spring 11*h* to open the through hole 11*e*. Therefore, the ink is flowed into the second pressure chamber 11*b* from the first pressure chamber 11*a* and the discharge of the ink from the outlet 16*b* is started again through suction by the tube pump 6 and the pressurization bellows unit 8.

In this case, in order to control the pressure "P2inA" to be a constant pressure by opening and closing the valve 11*g*, the pressure "P2out" is required to be not more than the pressure "P2inA" and it is preferable that the pressure "P2out" is set to be a sufficiently lower value than the pressure "P2inA".

Strictly, in the differential pressure regulator 11, a pressure obtained by multiplying a force of the pressure "P2out" acting on the valve 11*g* by an area of the valve 11*g* is occurred. However, since the area of the valve 11*g* is commonly small, the force may be ignored.

As described above, when an open-and-close operation of the valve 11*g* is repeated in a state that the pressure "P2out" is not more than the pressure "P2inA", a differential pressure between the pressure "P2inA" and the pressure "P2inB" is maintained to be substantially constant although some variation may be occurred. Further, the differential pressure between the pressure "P2inA" and the pressure "P2inB" which is maintained by the differential pressure regulator 11 becomes a set pressure of the differential pressure regulator 11. The set pressure of the differential pressure regulator 11 is determined based on the urging force "F2" of the pressure control spring 11*h* and the area "A2" of the diaphragm 11*c* and thus the set pressure of the differential pressure regulator 11 is adjusted by adjusting the strength of the pressure control spring 11*h*.

Then, the set pressure of the differential pressure regulator 11 which is structured as described above is set to be "2α" (second pressure) by adjusting the strength of the pressure control spring 11*h*. As a result, the pressure of the ink of the inlet 16*a* is maintained to be the center value "+α" of the designated head value by the pressurization regulator 10 and thus the pressure "P2inA" of the ink inputted into the first pressure chamber 11*a* is maintained to be the center value "−α" of the designated head value by opening and closing of the valve 11*g*. Therefore, the ink pressure of the outlet 16*b* communicated with the first pressure chamber 11*a* is also maintained to be the center value "−α" of the designated head value.

In this manner, the differential pressure of "2α" is generated between both end parts of the common ink flow passage 16 of the inkjet head 2 by setting the set pressure of the differential pressure regulator 11 to be "2α".

In this case, it is preferable that the differential pressure "2α" generated by the differential pressure regulator 11 is set to be a value so that ink is circulated to the extent that fine particles contained in liquid component of the ink are agitated. Further, it is preferable that the differential pressure "2α" is set to be a value within a range of a shape keeping strength of meniscus in which the meniscus shape of the ink formed in each nozzle 15 is not broken.

Therefore, the differential pressure "2α" generated between both end parts of the common ink flow passage 16 by the differential pressure regulator 11 is, for example, set to be 100 Pa. In this case, the set pressure of the pressurization regulator 10 is the center value +50 Pa of the designated head value and the set pressure of the differential pressure regulator 11 is 100 Pa.

In addition, the pressurization regulator 10 is required to set the pressure "P1in" of the ink flowing into the first pressure chamber 10*a* to be not less than the pressure "P1out" of the ink outputted from the second pressure chamber 10*b* and thus a pressure generated by the pressurization bellows unit 8 is, for example, set to be in a range from 5000 to 20000 Pa. Therefore, the pressure "P1in" of the ink which is flowed into the first pressure chamber 10*a* becomes in a range from 5000 to 20000 Pa. On the other hand, the differential pressure regulator 11 is required to set the pressure "P2out" of the ink outputted from the second pressure chamber 11*b* to be not more than the pressure "P2inA" of the ink flowed into the first pressure chamber 11*a* and thus a pressure generated by the pressure reduction bellows unit 9 is, for example, set to be in a range from −5000 to −20000 Pa. As a result, the pressure "P2out" of the ink which is flowed out from the second pressure chamber 11*b* becomes in a range from −5000 to −20000 Pa.

As described above, in the pressurization bellows unit 8, a pressure applied to the ink is varied due to hysteresis of the ON/OFF switching of the micro switch 8*b*. However, as long as the pressure "P1in" of the ink flowed into the first pressure chamber 10*a* is not less than the pressure "P1out" of the ink outputted from the second pressure chamber 10*b*, the pressurization regulator 10 maintains the pressure "P1out" of the ink outputted from the second pressure chamber 10*b* to be the center value "+α" of the designated head value. Therefore, even when pressure variation is occurred by the pressurization bellows unit 8, the pressure of the inlet 16*a* is maintained to be the center value "+α" of the designated head value.

Further, in the pressure reduction bellows unit 9, a pressure applied to the ink is varied due to hysteresis of the ON/OFF switching of the micro switch 9*b*. However, as long as the pressure "P2out" of the ink outputted from the second pressure chamber 11*b* is not more than the pressure "P2inA" of the ink flowed into the first pressure chamber 11*a*, the differential pressure regulator 11 maintains the differential pressure between the pressure "P2inA" and the pressure "P2inB" to be substantially constant. Therefore, even when pressure variation by the pressure reduction bellows unit 9 is occurred, the pressure of the outlet 16*b* is maintained to be the center value "−α" of the designated head value.

The high speed circulating flow passage 13 is structured of a long and thin tube-like member (tube), by which the inkjet head 2, the pressurization regulator 10 and the differential pressure regulator 11 are bypassed. The high speed circulating flow passage 13 is a flow passage for forcibly circulating ink at a high speed in the ink flow passage passing through the ink cartridge 3, the tube pump 6, the tube pump 7, the pressurization bellows unit 8 and the pressure reduction bellows unit 9. The high speed circulating flow passage 13 is, similarly to the supply flow passage 4 and the return flow passage 5, structured of a long and thin tube-like member (tube). One end of the high speed circulating flow passage 13 is connected between the pressurization bellows unit 8 and the pressurization regulator 10 in the supply flow passage 4, and the other end of the high speed circulating flow passage 13 is connected between the pressure reduction bellows unit 9 and the differential pressure regulator 11 in the return flow passage 5.

The high speed circulating flow passage 13 is capable of being opened and closed by an electromagnetic valve not shown. When the high speed circulating flow passage 13 is opened, ink is capable of bypassing the inkjet head 2, the pressurization regulator 10 and the differential pressure regulator 11 and circulating through the ink flow passage passing through the ink cartridge 3, the tube pump 6, the tube pump 7, the pressurization bellows unit 8 and the pressure reduction bellows unit 9.

Next, an operation of the ink circulation system 1 will be described below. An operation of the ink circulation system 1 includes a normal circulating operation which is performed in a normal time and a high-speed circulating operation and the respective operations will be described below successively.

First, a normal circulating operation which is performed in a normal time will be described below. The normal circulating operation is performed by driving the tube pump 6, the tube pump 7, the micro switch 8*b* of the pressurization bellows unit 8, and the micro switch 9*b* of the pressure reduction bellows unit 9 through a control section not shown. In the normal circulating operation, the high speed circulating flow passage 13 is closed.

In the normal circulating operation, the ink in the supply flow passage 4 is sent toward the inkjet head 2 by the tube pump 6. Further, the ink which is sent out by the tube pump 6 is pressurized, for example, in a range from 5000 to 20000 Pa by the pressurization bellows unit 8. Therefore, the ink which is filled in the ink cartridge 3 is pressure-fed toward the inlet 16*a* and the ink on the inlet 16*a* side of the inkjet head 2 in the supply flow passage 4 is pressurized, for example, in a range from 5000 to 20000 Pa.

In this case, in the pressurization regulator 10, the ink which is pressure-fed by the tube pump 6 and the pressurization bellows unit 8 is flowed into the first pressure chamber 10*a*. Then, when the pressure "P1out" of the ink which is flowed out from the second pressure chamber 10*b* to the inlet 16*a* becomes not more than the center value "+α" of the designated head value, the valve 10*f* opens the through hole 10*d*. As a result, the ink flowed into the first pressure chamber 10*a* is flowed out from the second pressure chamber 10*b* and supply of the ink to the inlet 16*a* is performed. On the other hand, the pressure "P1out" of the ink which is flowed out from the second pressure chamber 10*b* to the inlet 16*a* becomes higher than the center value "+α" of the designated head value, the valve 10*f* closes the through hole 10*d*. As a result, flow of the ink from the first pressure chamber 10*a* to the second pressure chamber 10*b* is shut off and the supply of the ink to the inlet 16*a* is stopped. As described above, the ink supplied to the inlet 16*a* is maintained to be the center value "+α" of the designated head value, which is the set pressure, by an open-and-close operation of the valve 10*f* based on the relationship between the pressure "P1out" of the ink flowing from the second pressure chamber 10*b* to the inlet 16*a* and the center value of the designated head value.

On the other hand, the ink in the return flow passage 5 is sent out toward the ink cartridge 3 by the tube pump 7 and the pressure on the outlet 16*b* side of the inkjet head 2 in the return flow passage 5 is depressurized, for example, in the range from −5000 to −20000 Pa by the pressure reduction bellows unit 9.

In this case, in the differential pressure regulator 11, the ink discharged from the outlet 16*b* is flowed into the first pressure chamber 11*a* and the ink flowed into the inlet 16*a* is flowed into the third pressure chamber 11*c*. Further, the ink supplied to the inlet 16*a* is reached to the outlet 16*b* through the common ink flow passage 16 and thereby the pressure of the first pressure chamber 11*a* is increased. Then, when a differential pressure between the pressure "P2inA" of the ink which is flowed from the outlet 16*b* into the first pressure chamber 11*a* and the pressure "P2inB" of the ink which is flowed from the pressurization regulator 10 into the third pressure chamber 11*c* becomes not more than "2α", the valve 11*g* opens the through hole 11*e*. Therefore, the ink discharged from the outlet 16*b* is flowed into the second pressure chamber 11*b* from the first pressure chamber 11*a* and is sent out by the tube pump 7 and the pressure reduction bellows unit 9. On the other hand, when the differential pressure between the pressure "P2inA" of the ink which is flowed from the outlet 16*b* into the first pressure chamber 11*a* and the pressure "P2inB" of the ink which is flowed from the pressurization regulator 10 into the third pressure chamber 11*c* becomes larger than "2α", the valve 11*g* closes the through hole 11*e*. Therefore, the flow of the ink from the first pressure chamber 11*a* to the second pressure chamber 11*b* is shut off and discharge of the ink from the outlet 16*b* is stopped. In this manner, the ink returned from the outlet 16*b* is maintained to be the center value "−α" of the designated head value which is the set pressure by an open-and-close operation of the valve 11*g* based on the differential pressure between the ink pressure of the inlet 16*a* and the ink pressure of the outlet 16*b*.

Therefore, the ink is flowed through the common ink flow passage 16 from the inlet 16*a* to the outlet 16*b* by the differential pressure of "2α" generated between the inlet 16*a* and the outlet 16*b*. In this manner, the ink stored in the ink cartridge 3 is circulated through the supply flow passage 4, the tube pump 6, the supply flow passage 4, the pressurization bellows unit 8, the supply flow passage 4, the pressurization regulator 10, the supply flow passage 4, the common ink flow passage 16 of the inkjet head 2, the return flow passage 5, the differential pressure regulator 11, the return flow passage 5, the pressure reduction bellows unit 9, the return flow passage 5, the tube pump 7, the return flow passage 5 and the ink cartridge 3.

Next, a high-speed circulating operation will be described below. The high-speed circulating operation is an operation by which ink is filled in the ink flow passage or, by which composition such as fine particles contained in the ink is surly agitated. The high-speed circulating operation is performed periodically or at an arbitrary time, for example, when the power of the inkjet printer is turned on or when the maintenance is performed. In the high-speed circulating operation, first, an electromagnetic valve for opening and closing the high speed circulating flow passage 12 is driven and controlled to open the high speed circulating flow passage 12. Therefore, since the ink is flowed to the high speed circulating flow passage 12, the ink is capable of bypassing the inkjet head 2, the pressurization regulator 10 and the differential pressure regulator 11 and circulating through the ink flow passage passing through the ink cartridge 3, the tube pump 6, the tube pump 7, the pressurization bellows unit 8 and the pressure reduction bellows unit 9.

Further, similarly to the normal circulating operation, the tube pump 6, the tube pump 7, the micro switch 8*b* of the pressurization bellows unit 8, and the micro switch 9*b* of the pressure reduction bellows unit 9 are driven and controlled. In this case, the tube pump 6 and the tube pump 7 are rotated at a higher speed than the normal circulating operation. As a result, the ink is circulated at a high speed through the ink flow passage passing through the ink cartridge 3, the tube pump 6, the tube pump 7, the pressurization bellows unit 8 and the pressure reduction bellows unit 9.

In this manner, composition such as fine particles contained in the ink is agitated sufficiently in the ink flow passage passing through the ink cartridge 3, the tube pump 6, the tube pump 7, the pressurization bellows unit 8 and the pressure reduction bellows unit 9 and its sedimentation and precipitation are restrained.

In accordance with an embodiment of the present invention, when the pressure loss of the high speed circulating flow passage 13 is set to be high, since the differential pressure of both ends of the high speed circulating flow passage 13 becomes large, the differential pressure similar to the normal time can be supplied to the pressurization regulator 10 and the differential pressure regulator 11. In this case, when the high speed circulating flow passage 13 is opened all the time, the bypassed circulating flow passage is strongly agitated all the time and, in addition, the differential pressure at the normal time is applied to the inkjet head 2 side from the high speed circulating flow passage 13 and thus it is suitable for the ink which is further easily precipitated.

As described above, according to the ink circulation system 1 in accordance with the first embodiment, ink is supplied from the ink cartridge 3 to the inlet 16*a* of the common ink flow passage 16 through the supply flow passage 4 and the ink is returned from the outlet 16*b* of the common ink flow passage 16 to the ink cartridge 3 through the return flow passage 5. Therefore, the ink which is stored in the ink cartridge 3 is circulated through the ink flow passage passing through the ink cartridge 3, the supply flow passage 4, the common ink flow passage 16 and the return flow passage 5. Further, the ink on the inkjet head 2 side in the supply flow passage 4 is pressurized by the tube pump 6 and the pressurization bellows unit 8 and the ink on the ink cartridge 3 side in the return flow passage 5 is depressurized by the tube pump 7 and the pressure reduction bellows unit 9 and thereby a differential pressure is generated between both end parts of the common ink flow passage 16. Therefore, the ink can be circulated in the ink flow passage passing through the ink cartridge 3, the supply flow passage 4, the common ink flow passage 16 and the return flow passage 5 and thus composition such as fine particles contained in the ink is agitated and sedimentation and precipitation of the composition such as the fine particles are restrained. Further, air bubbles stagnant in the piping can be flowed to remove appropriately.

In this case, since the pressurization regulator 10 is provided between the pressurization bellows unit 8 and the inlet 16*a* of the common ink flow passage 16, even when a pressure generated by the tube pump 6 and the pressurization bellows unit 8 is varied, the ink of the inlet 16*a* in the common ink flow passage 16 can be maintained to be the center value "+α" of the designated head value. Further, since the differential pressure regulator 11 is provided between the pressure reduction bellows unit 9 and the outlet 16*b* of the common ink flow passage 16, even when a pressure generated by the tube pump 7 and the pressure reduction bellows unit 9 is varied, a differential pressure of the ink of the outlet 16*b* with respect to the inlet 16*a* in the common ink flow passage 16 can be maintained to be "2α".

As described above, since the pressurization regulator 10 and the differential pressure regulator 11 are used, even when a differential pressure generating means which is unable to adjust pressure with a high degree of accuracy is adopted, variation of the pressure applied to the both end parts of the common ink flow passage is restrained and thus the ink can be circulated while the meniscus in the nozzle is maintained appropriately. In addition, the differential pressure generating means is not required to use an expensive member such as a pressure sensor and a complicated control and the pressurization regulator 10 and the differential pressure regulator 11 are simply and easily structured and thus the cost of the ink circulation system 1 can be reduced.

In this case, when the ink of the inlet 16*a* in the common ink flow passage 16 becomes higher than the center value "+α" of the designated head value, the pressurization regulator 10 shuts off the flow of the ink. Therefore, even when a pressure generated by the tube pump 6 and the pressurization bellows unit 8 is varied, the ink pressure of the inlet 16*a* in the common ink flow passage 16 is prevented from becoming lower than the center value "+α" of the designated head value and the ink pressure of the inlet 16*a* in the common ink flow passage 16 can be maintained to be the center value "+α" of the designated head value.

Further, in the pressurization regulator 10, a pressure of the second pressure chamber 10*b* communicated with the inlet 16*a* is normally a negative pressure and thus the diaphragm 10*c* is drawn to the second pressure chamber 10*b* side by the outside under atmospheric pressure and a force in a direction for opening the valve element 10*e* is generated. In this case, when a force which is applied to the diaphragm 10*c* by an ink pressure of the first pressure chamber 10*a* which presses the valve element 10*e* in an open direction becomes smaller than a force of the pressure control spring 10*g* which presses the valve element 10*e* in a close direction, the valve element 10*e* closes the through hole 10*d* and supply of the ink is stopped. Further, when the force which is applied to the diaphragm 10*c* by the ink pressure of the first pressure chamber 10*a* which presses the valve element 10*e* in an open direction becomes larger than the force of the pressure control spring 10*g* which presses the valve element 10*e* in a close direction, the valve element 10*e* opens the through hole 10*d* and the supply of the ink is started again. In this manner, passing and stop of the ink can be mechanically performed without a complicated control and thus the ink pressure of the inlet 16*a* in the common ink flow passage 16 can be maintained to be the center value "−α" of the designated head value.

Further, in the differential pressure regulator 11, when a pressure obtained by subtracting an ink pressure of the outlet 16*b* in the common ink flow passage 16 from an ink pressure of the inlet 16*a* in the common ink flow passage 16 becomes higher than "2α", the flow of the ink is shut off. Therefore, even when a pressure generated by the tube pump 7 and the pressure reduction bellows unit 9 is varied, a pressure of the ink of the outlet 16*b* can be maintained to be "2α" with respect to a pressure of the ink of the inlet 16*a* in the common ink flow passage 16.

Further, in the differential pressure regulator 11, when a force which is applied to the diaphragm 11*d* for acting on the valve element 11*f* in a close direction by a differential pressure which is obtained by subtracting a pressure of the ink flowed into the first pressure chamber 11*a* from a pressure of the ink flowed into the third pressure chamber 11*c* becomes larger than a force of the pressure control spring 11*h* which presses the valve element 11*f* in an open direction, the valve element 11*f* closes the through hole 11*e* and the supply of the ink is stopped. Further, when the force which is applied to the diaphragm 11*d* for acting on the valve element 11*f* in the close direction by the differential pressure obtained by subtracting the pressure of the ink flowed into the first pressure chamber 11*a* from the pressure of the ink flowed into the third pressure chamber 11*c* becomes smaller than the force of the pressure control spring 11*h* which presses the valve element 11*f* in the open direction, the valve element 11*f* opens the through hole 11*e* and the supply of the ink is started again. In this manner, passing and stop of the ink can be mechanically performed without a complicated control and thus the differential pressure between both end parts in the common ink flow passage 16 can be maintained to be "2α".

Further, since a pressure generated by the pressurization regulator 10 at the inlet 16*a* and a pressure generated by the differential pressure regulator 11 at the outlet 16*b* are set to be values interposing the center value of the designated head value, an average pressure of the common flow passage 16 can be brought close to the center value of the designated head value and thus the meniscus of the ink formed in each nozzle 15 of the inkjet head 2 can be prevented from being broken.

Further, since the tube pump 6 and the pressurization bellows unit 8 are provided in the supply flow passage 4, ink on the inlet 16*a* side in the common ink flow passage 16 can be pressurized and, since the tube pump 7 and the pressure reduction bellows unit 9 are provided in the return flow passage 5, ink on the outlet 16*b* side in the common ink flow passage 16 can be depressurized. Therefore, a predetermined differential pressure can be generated between both end parts of the common ink flow passage 16. Accordingly, since a predetermined differential pressure is generated between both end parts of the common ink flow passage 16 with a simple structure such as a bellows unit or a tube pump to circulate the ink and thus the cost is further can be reduced.

Further, the pressures generated in the pressurization bellows unit 8 and the pressure reduction bellows unit 9 are adjusted and thereby the pressure of the center value of the designated head value can be applied to the inkjet head 2 without being restricted by a height position of the ink cartridge 3. Therefore, the ink cartridge 3 can be disposed at an arbitrary height position by using the pressurization bellows unit 8 and the pressure reduction bellows unit 9.

Further, when the ink stored in the ink cartridge 3 is used up, the ink is not supplied to the pressurization bellows unit 8 and thus the micro switch 8*b* is not switched. Therefore, a state that the ink in the ink cartridge 3 is used up can be detected by monitoring the switching of the micro switch 8*b*.

Second Embodiment

Figure 5:
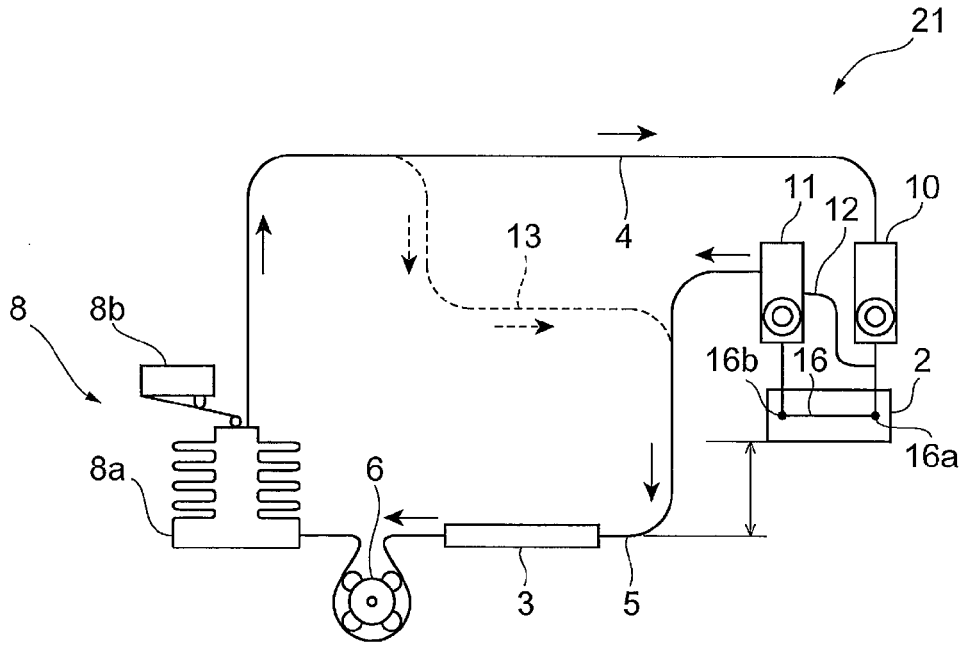
FIG. 5 is a schematic structure view showing an ink circulation system in accordance with a second embodiment of the present invention.

Next, an ink circulation system in accordance with a second embodiment will be described below with reference to FIG. 5. FIG. 5 is a schematic structure view showing an ink circulation system in accordance with the second embodiment of the present invention. As shown in FIG. 5, the ink circulation system 21 in accordance with the second embodiment includes an inkjet head 2, an ink cartridge 3, a supply flow passage 4, a return flow passage 5, a tube pump 6, a pressurization bellows unit 8, a pressurization regulator 10, a differential pressure regulator 11 and a high speed circulating flow passage 13.

In other words, in the ink circulation system 21, the tube pump 7 and the pressure reduction bellows unit 9 in the ink circulation system 1 in accordance with the first embodiment are not used and the ink cartridge 3 is disposed at a lower position with respect to the inkjet head 2.

As described above, in the differential pressure regulator 11, in order that an open-and-close operation of the valve 11*g* is not affected by the pressure "P2out" of the ink which is outputted from the second pressure chamber 11*b*, the pressure "P2out" is required to be not more than the pressure "P2inA" of the ink which is flowed into the first pressure chamber 11*a*. However, in the ink circulation system 21, a pressure adjustment means such as a tube pump and a pressure reduction bellows unit is not provided between the differential pressure regulator 11 and the ink cartridge 3 in the return flow passage 5. Therefore, in the ink circulation system 21, the ink cartridge 3 is disposed at a relatively lower position with respect to the inkjet head 2 so that the inkjet head 2 becomes not more than the center value "$-\alpha$" of the designated head value. In this case, it is preferable that the ink cartridge 3 is disposed at a relatively lower position with respect to the inkjet head 2 so that the head value of the inkjet head 2 becomes remarkably lower than the center value "$-\alpha$" of the designated head value.

Next, an operation of the ink circulation system 21 will be described below. A high-speed circulating operation is basically similar to the first embodiment and thus only a normal circulating operation will be described below.

In the normal circulating operation, the tube pump 6 and a micro switch 8*b* of the pressurization bellows unit 8 are driven by a control section not shown. In the normal circulating operation, the high speed circulating flow passage 13 is closed.

In the normal circulating operation, ink in the supply flow passage 4 is sent toward the inkjet head 2 by the tube pump 6 and ink on the inlet 16*a* side of the inkjet head 2 in the supply flow passage 4 is pressurized, for example, in a range from 5000 to 20000 Pa by the pressurization bellows unit 8. Further, the ink of the inlet 16*a* is maintained to be a pressure of the center value "$+\alpha$" of the designated head value by the pressurization regulator 10.

On the other hand, since the ink cartridge 3 is disposed at a position that the head value of the inkjet head 2 becomes not more than the center value "$-\alpha$" of the designated head value, the second pressure chamber 11*b* in the differential pressure regulator 11 becomes not more than the center value "$-\alpha$" of the designated head value. Further, in the differential pressure regulator 11, a differential pressure between the ink of the inlet 16*a* and the ink of the outlet 16*b* is maintained to be "$2\alpha$" by an open-and-close operation of the valve 11*g*. Therefore, a suction pressure of the ink (not more than the center value "$-\alpha$" of the designated head value) based on the height difference of the ink cartridge 3 is maintained to be the center value "$-\alpha$" of the designated head value by an open-and-close operation of the valve 11*g* in the differential pressure regulator 11 and the ink is sucked from the outlet 16*b*.

As a result, the differential pressure of "$2\alpha$" is generated between the inlet 16*a* and the outlet 16*b* and thus the ink is flowed from the inlet 16*a* to the outlet 16*b* in the common ink flow passage 16. Therefore, the ink stored in the ink cartridge 3 is circulated through the supply flow passage 4, the tube pump 6, the supply flow passage 4, the pressurization bellows unit 8, the supply flow passage 4, the pressurization regulator 10, the supply flow passage 4, the common ink flow passage 16 of the inkjet head 2, the return flow passage 5, the differential pressure regulator 11, the return flow passage 5 and the ink cartridge 3.

As described above, according to the ink circulation system 21 in accordance with the second embodiment, the following operation-effects are obtained in addition to the operation-effects of the above-mentioned ink circulation system. In other words, according to the ink circulation system 21 in accordance with the second embodiment, since the ink cartridge 3 is disposed at a lower position with respect to the inkjet head 2, the ink on the outlet 16*b* side in the return flow passage 5 is depressurized and thus a differential pressure is generated between both end parts of the common ink flow passage 16. Therefore, the ink can be circulated through the ink flow passage.

In addition, the ink cartridge 3 is disposed so that a pressure of the ink on the inkjet head 2 side in the return flow passage 5 is not more than the center value "$-\alpha$" of the designated head value and thus the pressure of the ink in the outlet 16*b* can be maintained to be the center value "$-\alpha$" of the designated head value by the differential pressure regulator 11. Therefore, an average pressure of the common ink flow passage 16 can be brought close to the center value of the designated head value and thus the meniscus of the ink formed in each nozzle 15 of the inkjet head 2 can be prevented from being broken.

Third Embodiment

Figure 6:
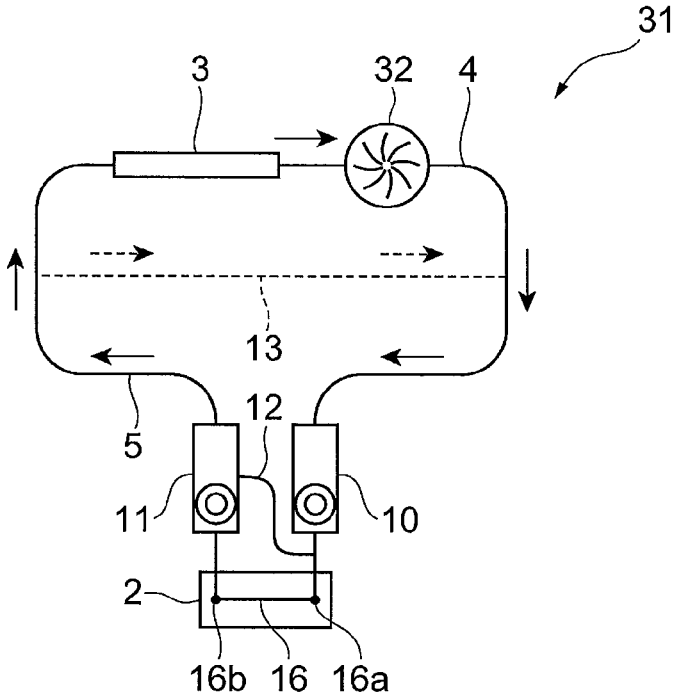
FIG. 6 is a schematic structure view showing an ink circulation system in accordance with a third embodiment of the present invention.

Next, an ink circulation system in accordance with a third embodiment will be described below with reference to FIG. 6. FIG. 6 is a schematic structure view showing an ink circulation system in accordance with the third embodiment of the present invention. As shown in FIG. 6, the ink circulation system 31 in accordance with the third embodiment includes an inkjet head 2, an ink cartridge 3, a supply flow passage 4, a return flow passage 5, a pressurization regulator 10, a differential pressure regulator 11, a high speed circulating flow passage 13, and a differential pressure generating pump 32.

The differential pressure generating pump 32 is structured of a so-called centrifugal pump, which forcibly sends out ink from an input port to an output port to generate a differential pressure between the input port and the output port. In the differential pressure generating pump 32, the input port into which the ink is inputted is connected with the ink cartridge 3 and the output port from which the ink is outputted is connected with the pressurization regulator 10.

The differential pressure generating pump 32 forcibly sends out ink to the pressurization regulator 10 and thereby the supply flow passage 4 on the pressurization regulator 10 side is pressurized, and ink is sucked from the ink cartridge 3 to depressurize the return flow passage 5. In this manner, a differential pressure is generated between an inlet 16*a* and an outlet 16*b* of a common ink flow passage 16. Further, a drive force of the differential pressure generating pump 32 is adjusted and thereby a pressure "P1in" of the ink which is pressure-fed into a first pressure chamber 10*a* of the pressurization regulator 10 is, for example, set in a range from 5000 to 20000 Pa and a pressure "P2out" of the ink which is sucked from a second pressure chamber 11*b* of the differential pressure regulator 11 is, for example, set in a range from −5000 to −20000 Pa.

Next, an operation of the ink circulation system 31 will be described below. In this embodiment, a high-speed circulating operation is basically similar to the first embodiment and thus only a normal circulating operation will be described below.

In the normal circulating operation, the differential pressure generating pump 32 is driven by a control section not shown.

As a result, ink is sucked from the ink cartridge 3 by the differential pressure generating pump 32 and the sucked ink is forcibly sent out to the pressurization regulator 10. Therefore, the ink on the inlet 16*a* side of the inkjet head 2 in the supply flow passage 4 is, for example, pressurized in a range from 5000 to 20000 Pa and a pressure on the outlet 16*b* side of the inkjet head 2 in the return flow passage 5 is, for example, depressurized in a range from −5000 to −20000 Pa.

Further, the ink of the inlet 16*a* is maintained to be a pressure of the center value "+α" of the designated head value by the pressurization regulator 10. On the other hand, in the differential pressure regulator 11, a differential pressure between the ink of the inlet 16*a* and the ink of the outlet 16*b* is maintained to be "2α" by an open-and-close operation of the valve 11*g*. Therefore, a suction pressure by the differential pressure generating pump 32 is maintained to be the center value "−α" of the designated head value by an open-and-close operation of the valve 11*g* in the differential pressure regulator 11 and the ink is sucked from the outlet 16*b*.

As a result, a differential pressure of "2α" is generated between the inlet 16*a* and the outlet 16*b* and thus the ink is flowed from the inlet 16*a* to the outlet 16*b* in the common ink flow passage 16. Therefore, the ink stored in the ink cartridge 3 is circulated through the supply flow passage 4, the differential pressure generating pump 32, the supply flow passage 4, the pressurization regulator 10, the supply flow passage 4, the common ink flow passage 16 of the inkjet head 2, the return flow passage 5, the differential pressure regulator 11, the return flow passage 5 and the ink cartridge 3.

As described above, according to the ink circulation system 31 in accordance with the third embodiment, the following operation-effects are obtained together with the operation-effects of the above-mentioned ink circulation systems. In other words, according to the ink circulation system 31 in accordance with the third embodiment, a differential pressure is also generated between both end parts of the common ink flow passage 16 by the differential pressure generating pump 32. Therefore, the ink is circulated in the ink flow passage and thus composition such as fine particles contained in the ink can be agitated and sedimentation and precipitation of the composition such as the fine particles are restrained. Further, air bubbles stagnant in the piping can be flowed to remove appropriately.

In addition, a pressure can be applied to the ink flow passage by the differential pressure generating pump 32 and thus, when the pressure generated by the differential pressure generating pump 32 is adjusted, a pressure of the center value of the designated head value can be applied to the inkjet head 2 without being restricted by a height position of the ink cartridge 3. Therefore, the ink cartridge 3 can be disposed at an arbitrary height position by using the differential pressure generating pump 32.

Fourth Embodiment

Figure 7:
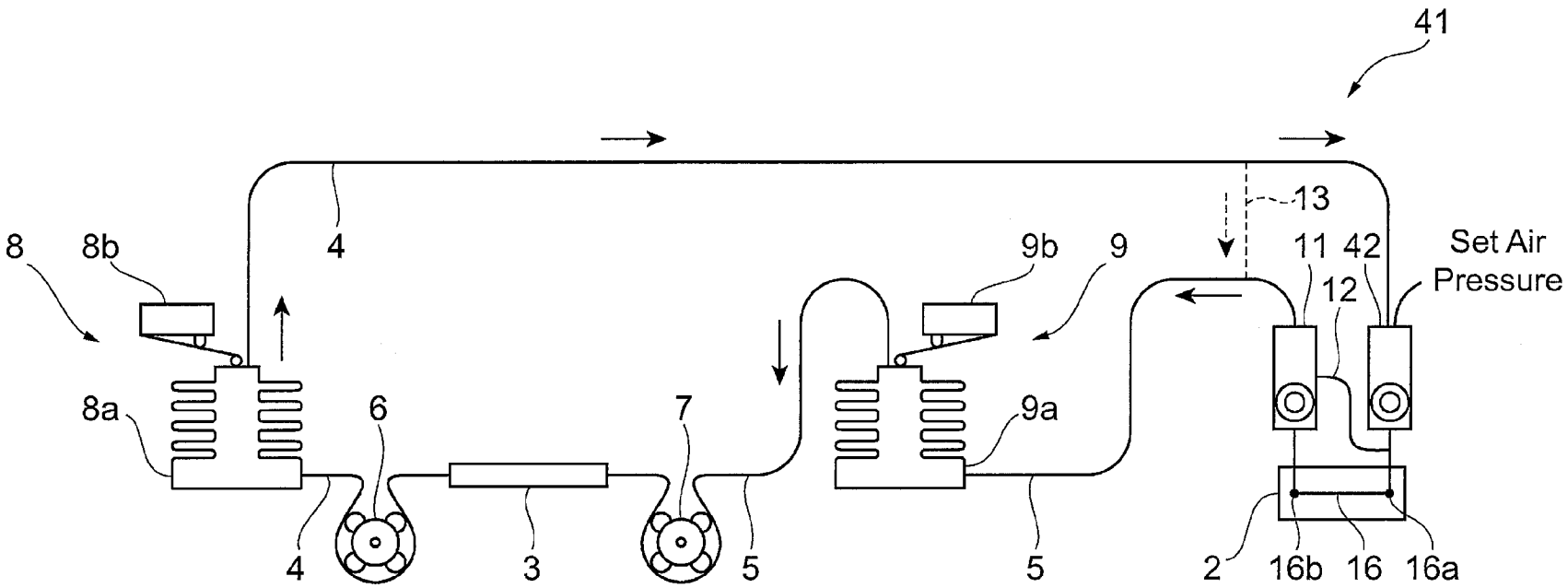
FIG. 7 is a schematic structure view showing an ink circulation system in accordance with a fourth embodiment of the present invention.

Next, an ink circulation system in accordance with a fourth embodiment will be described below with reference to FIG. 7. FIG. 7 is a schematic structure view showing an ink circulation system in accordance with the fourth embodiment of the present invention. As shown in FIG. 7, an ink circulation system 41 in accordance with the fourth embodiment includes an inkjet head 2, an ink cartridge 3, a supply flow passage 4, a return flow passage 5, a tube pump 6, a tube pump 7, a pressurization bellows unit 8, a pressure reduction bellows unit 9, a pilot air type pressurization regulator 42, a differential pressure regulator 11, a branched flow passage 12 and a high speed circulating flow passage 13.

In other words, in the ink circulation system 41, the pressurization regulator 10 of the ink circulation system 1 in accordance with the first embodiment is replaced with the pilot air type pressurization regulator 42.

The pilot air type pressurization regulator 42 is disposed between the pressurization bellows unit 8 and the inkjet head 2 and maintains the inlet 16*a* of the common ink flow passage 16 to be a pressure not more than a predetermined pressure.

Figure 8A:
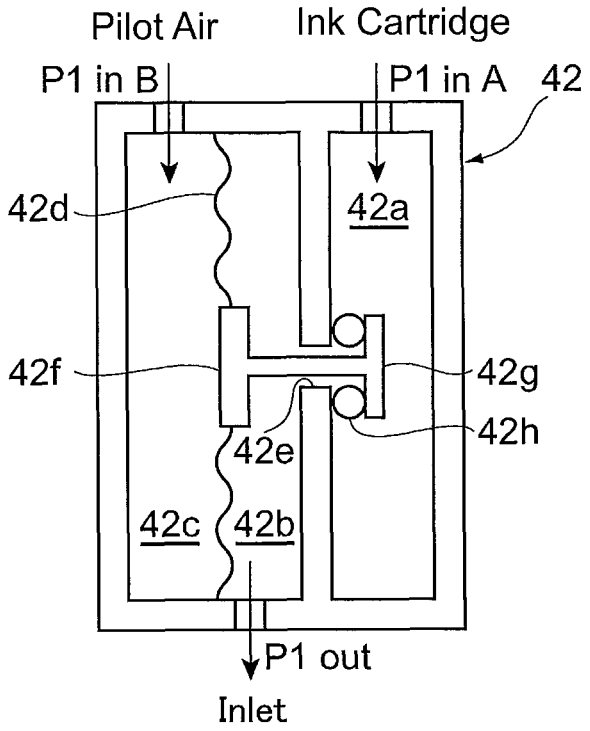
FIG. 8A and FIG. 8B are views showing a model of a pilot air type pressurization regulator.
Figure 8B:
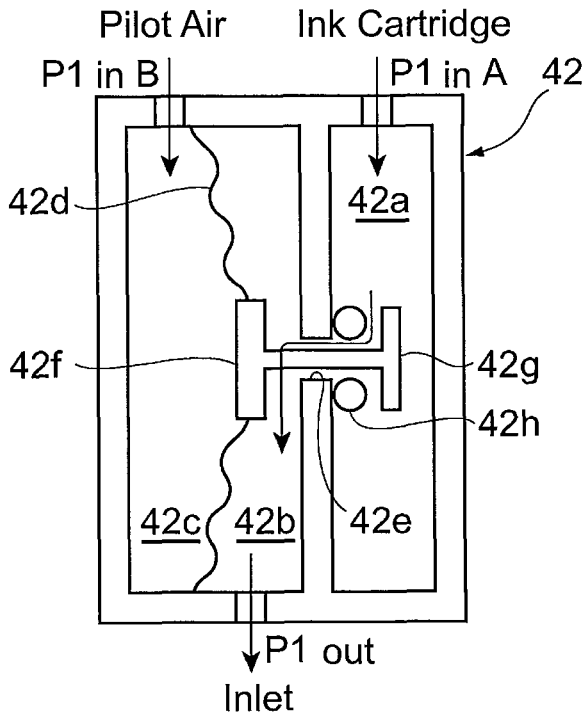

FIG. 8A and FIG. 8B are views showing a model of a pilot air type pressurization regulator. FIG. 8A shows a state that a valve is closed and FIG. 8B shows a state that the valve is opened. As shown in FIGS. 8A and 8B, the pilot air type pressurization regulator 42 is formed with a first pressure chamber 42*a* into which ink supplied from the ink cartridge 3 is flowed, a second pressure chamber 42*b* from which ink is flowed out to an inlet 16*a* of the common ink flow passage 16, and a third pressure chamber 42*c* into which pilot air having a set air pressure is flowed. The second pressure chamber 42*b* and the third pressure chamber 42*c* are partitioned by a diaphragm 42*d* and a through hole 42*e* is formed between the first pressure chamber 42*a* and the second pressure chamber 42*b* so as to communicate with each other and so that ink is flowed from the first pressure chamber 42*a* to the second pressure chamber 42*b*. A valve element 42*f* for opening and closing the through hole 42*e* is inserted into the through hole 42*e*. One end of the valve element 42*f* is connected with the diaphragm 42*d* and is movably held by the diaphragm 42*d* and its other end is formed with a valve 42*g* for closing the through hole 42*e* from the first pressure chamber 42*a* side. The valve element 42*f* is formed in a length so that the valve 42*g* closes the through hole 42*e* when there is no pressure difference between the first pressure chamber 42*a* and the second pressure chamber 42*b*. In the first pressure chamber 42*a*, an O-ring 42*h* for sealing is attached at a position corresponding to the valve 42*g*. Further, a set air pressure of the pilot air which is flowed into the third pressure chamber 42*c* is adjustable by a pump (pressure source) not shown.

In this embodiment, a pressure of ink which is flowed into the first pressure chamber 42*a* is set to be "P1inA", a pressure of ink which is outputted from the second pressure chamber 42*b* is set to be "P1out", and a set air pressure of the pilot air which is flowed into the third pressure chamber 42*c* is set to be "P1inB".

In the pilot air type pressurization regulator 42 which is structured as described above, when the pressure "P1inB" is higher than the pressure "P1out", the diaphragm 42*d* is deformed in a direction that the valve element 42*f* is opened (right direction in FIGS. 8A and 8B). Further, when the pressure "P1inB" is lower than the pressure "P1out", the diaphragm 42*d* is deformed in a direction that the valve element 42*f* is closed (left direction in FIGS. 8A and 8B).

Therefore, as shown in FIG. 8A, when the pressure "P1out" becomes not less than the set air pressure "P1inB" of the pilot air (P1out≥P1inB), the through hole 42*e* is closed by the valve 42*g* through the movement of the valve element 42*f* due to deformation of the diaphragm 42*d*. As a result, the flow of the ink from the first pressure chamber 42*a* to the second pressure chamber 42*b* is shut off and supply of the ink to the inlet 16*a* is stopped.

On the other hand, as shown in FIG. 8B, when the pressure "P1out" becomes lower than the set air pressure "P1inB" of the pilot air (P1out<P1inB), the through hole 42*e* is opened by the movement of the valve element 42*f* due to deformation of the diaphragm 42*d*. As a result, ink is flowed into the second pressure chamber 42*b* from the first pressure chamber 42*a* and supply of the ink to the inlet 16*a* is started again.

In this case, in order to control the pressure "P1out" to be a constant pressure by opening and closing the valve 42*g*, the pressure "P1inA" is required to be not less than the pressure "P1out" and it is preferable that the pressure "P1inA" is set to be a sufficiently higher value than the pressure "P1out".

Strictly, in the pilot air type pressurization regulator 42, a force obtained by multiplying a pressure of the pressure "P1inA" acting on the valve 42*g* by an area of the valve 42*g* is occurred. However, since the area of the valve 42*g* is normally small, the force may be ignored.

As described above, when an open-and-close operation of the valve 42*g* is repeated in a state that the pressure "P1out" is not more than the pressure "P1inA", the pressure "P1out" is maintained to be the set air pressure "P1inB" of the pilot air although some variation may be occurred.

In the pilot air type pressurization regulator 52 which is structured as described above, the set air pressure of the pilot air is set to be the center value "+α" of the designated head value. As a result, the pressure "P1out" of the ink which is outputted from the second pressure chamber 42*b* by an open-and-close operation of the valve 42*g* is maintained to be the center value "+α" of the designated head value and thus the ink pressure of the inlet 16*a* which is communicated with the second pressure chamber 42*b* is also maintained to be the center value "+α" of the designated head value.

In addition, the pilot air type pressurization regulator 42 is required to set the pressure "P1inA" of the ink flowing into the first pressure chamber 42*a* to be not less than the pressure "P1out" of the ink outputted from the second pressure chamber 42*b* and thus a pressure generated by the pressurization bellows unit 8 is, for example, set to be in a range from 5000 to 20000 Pa. Therefore, the pressure "P1inA" of the ink which is flowed into the first pressure chamber 42*a* becomes in a range from 5000 to 20000 Pa.

As described above, in the pressurization bellows unit 8, a pressure applied to the ink is varied due to hysteresis of the ON/OFF switching of the micro switch 8*b*. However, in the pilot air type pressurization regulator 42, as long as the pressure "P1inA" of the ink flowed into the first pressure chamber 42*a* is not less than the pressure "P1out" of the ink outputted from the second pressure chamber 42*b*, the pressure "P1out" of the ink outputted from the second pressure chamber 42*b* is maintained to be the center value "+α" of the designated head value. Therefore, even when pressure variation is occurred by the pressurization bellows unit 8, the pressure of the inlet 16*a* is maintained to be the center value "+α" of the designated head value.

Next, an operation of the ink circulation system 41 will be described below. A high-speed circulating operation is basically similar to the first embodiment and thus only a normal circulating operation will be described below.

The normal circulating operation is performed by driving the tube pump 6, the tube pump 7, the micro switch 8*b* of the pressurization bellows unit 8, and the micro switch 9*b* of the pressure reduction bellows unit 9 through a control section not shown. In the normal circulating operation, the high speed circulating flow passage 13 is closed.

In the normal circulating operation, the ink in the supply flow passage 4 is sent toward the inkjet head 2 by the tube pump 6. Further, the ink which is sent out by the tube pump 6 is pressurized, for example, in a range from 5000 to 20000 Pa by the pressurization bellows unit 8. Therefore, the ink which is filled in the ink cartridge 3 is pressure-fed toward the inlet 16*a* and the ink on the inlet 16*a* side of the inkjet head 2 in the supply flow passage 4 is pressurized, for example, in a range from 5000 to 20000 Pa.

In this case, in the pilot air type pressurization regulator 42, pilot air adjusted at the set pressure of the center value "+α" of the designated head value is flowed into the third pressure chamber 42*c* and the ink which is pressure-fed by the tube pump 6 and the pressurization bellows unit 8 is flowed into the first pressure chamber 42*a*. Then, when the pressure "P1out" of the ink which is flowed into the inlet 16*a* from the second pressure chamber 42*b* becomes not more than the set air pressure "P1inB" of the pilot air, the valve 42*g* opens the through hole 42*e*. As a result, the ink flowed into the first pressure chamber 42*a* is flowed out from the second pressure chamber 42*b* and supply of the ink to the inlet 16*a* is performed. On the other hand, the pressure "P1out" of the ink which is flowed out from the second pressure chamber 42*b* to the inlet 16*a* becomes higher than the set air pressure "P1inB" of the pilot air, the valve 42*g* closes the through hole 42*e*. As a result, the flow of the ink from the first pressure chamber 42*a* to the second pressure chamber 42*b* is shut off and the supply of the ink to the inlet 16*a* is stopped. As described above, the valve 42*g* is opened and closed based on the relationship between the pressure "P1out" of the ink flowing to the inlet 16*a* from the second pressure chamber 42*b* and the set air pressure "P1inB" of the pilot air and thereby the ink which is pressure-fed by the tube pump 6 and the pressurization bellows unit 8 is maintained to be the center value "−α" of the designated head value, which is the set air pressure of the pilot air type pressurization regulator 42, and is supplied to the inlet 16*a*.

On the other hand, in the differential pressure regulator 11, a differential pressure between the ink of the inlet 16*a* and the ink of the outlet 16*b* is maintained to be "2α" by an open-and-close operation of the valve 11*g*. Therefore, a suction pressure by the differential pressure generating pump 32 is maintained to be the center value "−α" of the designated head value by an open-and-close operation of the valve 11*g* in the differential pressure regulator 11 and the ink is sucked from the outlet 16*b*.

Therefore, the ink is flowed in the common ink flow passage 16 from the inlet 16*a* to the outlet 16*b* by the differential pressure of "2α" which is generated between the inlet 16*a* and the outlet 16*b*. In this manner, the ink stored in the ink cartridge 3 is circulated through the supply flow passage 4, the tube pump 6, the supply flow passage 4, the pressurization bellows unit 8, the supply flow passage 4, the pilot air type pressurization regulator 42, the supply flow passage 4, the common ink flow passage 16 of the inkjet head 2, the return flow passage 5, the differential pressure regulator 11, the return flow passage 5, the pressure reduction bellows unit 9, the return flow passage 5, the tube pump 7, the return flow passage 5 and the ink cartridge 3.

As described above, according to the ink circulation system 41 in accordance with the fourth embodiment, the following operation-effects are obtained in addition to the operation-effects of the above-mentioned ink circulation systems. In other words, according to the ink circulation system 41 in accordance with the fourth embodiment, in the pilot air type pressurization regulator 42, supply and stop of ink is switched based on the pressure difference between the ink pressure which is flowed into the inlet 16*a* from the second pressure chamber 42*b* and the air pressure of the pilot air which is flowed into the third pressure chamber 42*c*. Therefore, the ink pressure of the inlet 16*a* can be easily changed by changing the set air pressure of the pilot air and thus the degree of freedom of the set pressure is remarkably improved and, even when a plurality of the pressurization regulators is used, the set pressure can be changed simultaneously.

Further, when the ink pressure discharged from the second pressure chamber 42*b* becomes higher than the pressure of the pilot air which is flowed into the third pressure chamber 42*c*, the valve element 42*f* closes the through hole 42*e* to stop the supply of the ink and, when the ink pressure discharged from the second pressure chamber 42*b* becomes lower than the pressure of the pilot air which is flowed into the third pressure chamber 42*c*, the valve element 42*f* opens the through hole 42*e* and the supply of the ink is started again. Therefore, passing and stop of the ink can be mechanically performed by setting the pressure of the pilot air which is flowed into the third pressure chamber 42*c* without performing complicated control and thus the ink pressure of the inlet 16*a* in the common ink flow passage 16 can be further surely maintained to be the set pressure.

Although the present invention has been shown and described with reference to a specific embodiment, various changes and modifications will be apparent to those skilled in the art from the teachings herein. For example, in the embodiments described above, as a means structured to pressurize and supply the ink from the ink cartridge 3 to the inkjet head 2, (1) the tube pump 6 and the pressurization bellows unit 8, or (2) the differential pressure generating pump 32 is adopted, as a supply pressure setting means to the inlet 16*a*, (1) the pressurization regulator 10, or (2) the pilot air type pressurization regulator 42 is adopted, as a return pressure setting means from the outlet 16*b*, (1) the differential pressure regulator 11, (2) the arrangement relationship of the inkjet head 2 and the ink cartridge 3, or (3) the pressure loss control by the tube pump 7 is adopted and, as a means structured to depressurize and return the ink from the inkjet head 2 to the ink cartridge 3, (1) the tube pump 7 and the pressure reduction bellows unit 9, (2) the differential pressure generating pump 32, (3) the arrangement relationship of the inkjet head 2 and the ink cartridge 3, or (4) the pressure loss control by the tube pump 7 is adopted. However, combination of these means can be changed appropriately and the respective means can be structured of another structural means.

Further, in the embodiments described above, an ink circulation system which is mounted on an inkjet printer is described as an example of the present invention. However, the present invention may be applied to a liquid circulation system mounted on an industrial droplet ejection device in which high viscosity liquid such as edible oil or adhesive is ejected as a droplet.

The invention claimed is:

1. A liquid circulation system which is mounted on a droplet ejection device, comprising:

a droplet ejection head which is formed with a common flow passage communicated with a plurality of nozzles from which the droplets are ejected;

a liquid filling container which is filled with liquid that is supplied to the droplet ejection head;

a first flow passage through which the liquid is supplied from the liquid filling container to one end part of the common flow passage;

a second flow passage through which the liquid is returned from an other end part of the common flow passage to the liquid filling container;

a differential pressure generating means structured to pressurize the liquid on one end part side in the common flow passage and depressurize the liquid on an other end part side in the common flow passage;

a pressurization regulator which is disposed between the differential pressure generating means and the one end part of the common flow passage and is structured to maintain the liquid at the one end part in the common flow passage to be a first pressure; and a differential pressure regulator which is disposed between the differential pressure generating means and the other end part of the common flow passage and is structured to maintain a differential pressure between both end parts in the common flow passage to be a second pressure, wherein the differential pressure generating means pressurizes the liquid on the one end part side in the common flow passage by a pressurization bellows for pressurizing the liquid and a first tube pump for sending the liquid to a liquid droplet ejection head side, the differential pressure generating means depressurizes the liquid on the other end part side in the common flow passage by a pressure reduction bellows for depressurizing the liquid and a second tube pump for sending the liquid to a liquid filling container side, and a height difference is provided between the droplet ejection head and the liquid filling container so that a liquid pressure at the other end part in the common flow passage is lower than a liquid pressure at the one end part in the common flow passage.

2. The liquid circulation system according to claim 1, wherein the differential pressure regulator shuts off flow of the liquid when a pressure obtained by subtracting a pressure of the liquid of the other end part of the common flow passage from a pressure of the liquid of the one end part of the common flow passage becomes higher than the second pressure, and the differential pressure regulator flows the liquid when the pressure obtained by subtracting the pressure of the liquid of the other end part of the common flow passage from the pressure of the liquid of the one end part of the common flow passage becomes lower than the second pressure.

3. The liquid circulation system according to claim 1, wherein the pressurization regulator shuts off flow of the liquid when a pressure of the liquid of the one end part in the common flow passage becomes higher than the first pressure and flows the liquid when the pressure of the liquid of the one end part in the common flow passage becomes lower than the first pressure.

4. The liquid circulation system according to claim 2, wherein the differential pressure regulator comprises:

a first pressure chamber into which the liquid returned from the other end part of the common flow passage is flowed;

a second pressure chamber which is formed with a through hole communicated with the first pressure chamber and from which the liquid is discharged to a flow passage communicated with a negative pressure side of the differential pressure generating part;

a third pressure chamber into which the liquid supplied to the one end part of the common flow passage is flowed;

a diaphragm which separates the first pressure chamber from the third pressure chamber;

a valve element which is connected with the diaphragm for opening and closing the through hole; and a pressure control spring which urges the valve element in a direction for opening the through hole.

5. The liquid circulation system according to claim 3, wherein the pressurization regulator comprises:

a first pressure chamber into which the liquid is flowed from the liquid filling container through a pressurization side of a differential pressure generating part;

a second pressure chamber which is formed with a through hole communicated with the first pressure chamber and from which the liquid is sent to the one end part of the common flow passage;

a diaphragm which separates the second pressure chamber from ambient atmosphere;

a valve element which is connected with the diaphragm for opening and closing the through hole; and a pressure control spring which urges the valve element in a direction for closing the through hole.

6. The liquid circulation system according to claim 3, wherein air which is adjusted at a predetermined pressure is introduced into the pressurization regulator, and the pressurization regulator opens and closes a liquid flow passage based on comparison of a pressure of the air with a liquid pressure which is discharged to the one end part of the common flow passage.

7. The liquid circulation system according to claim 6, wherein the pressurization regulator comprises:

a first pressure chamber into which the liquid is flowed from the liquid filling container;

a second pressure chamber which is formed with a through hole communicated with the first pressure chamber and from which the liquid is discharged to the one end part of the common flow passage;

a third pressure chamber into which air at a predetermined pressure is flowed;

a diaphragm which separates the second pressure chamber from the third pressure chamber; and a valve element which is connected with the diaphragm for opening and closing the through hole.

8. The liquid circulation system according to claim 1, wherein the first pressure and the second pressure are set to be within a range of a designated water head of the droplet ejection head, the first pressure is a pressure higher by a predetermined pressure than a center value of the designated head value of the droplet ejection head, and the second pressure is a pressure of two times of the predetermined pressure.

9. The liquid circulation system according to claim 1, wherein the differential pressure generating means comprises a differential pressure generating pump which is provided in the first flow passage or the second flow passage for generating a differential pressure.

* * * * *